US007963782B2

(12) United States Patent
Hughes

(10) Patent No.: US 7,963,782 B2
(45) Date of Patent: Jun. 21, 2011

(54) SEPARABLE CONNECTOR SYSTEM WITH A POSITION INDICATOR

(75) Inventor: David Charles Hughes, Rubicon, WI (US)

(73) Assignee: Cooper Technologies Company, Houston, TX (US)

( * ) Notice: Subject to any disclaimer, the term of this patent is extended or adjusted under 35 U.S.C. 154(b) by 146 days.

(21) Appl. No.: 12/340,053

(22) Filed: Dec. 19, 2008

(65) Prior Publication Data

US 2009/0215307 A1 Aug. 27, 2009

Related U.S. Application Data

(63) Continuation-in-part of application No. 12/072,513, filed on Feb. 25, 2008.

(51) Int. Cl.
*H01R 13/53* (2006.01)

(52) U.S. Cl. ..... 439/181

(58) Field of Classification Search ..... 439/181, 439/183, 709, 187, 921; 174/73.1, 37
See application file for complete search history.

(56) References Cited

U.S. PATENT DOCUMENTS

| | | | | |
|---|---|---|---|---|
| 1,903,956 | A | 4/1933 | Christie et al. | |
| 3,576,493 | A | 4/1971 | Tachick et al. | |
| 3,798,586 | A | 3/1974 | Huska | |
| 3,924,914 | A | 12/1975 | Banner | |
| 3,953,099 | A | 4/1976 | Wilson | |
| 4,107,486 | A | 8/1978 | Evans | |
| 4,186,985 | A | 2/1980 | Stepniak et al. | |
| 4,456,942 | A | 6/1984 | Bronikowski | |
| 4,568,804 | A | 2/1986 | Luehring | |
| 4,793,637 | A | 12/1988 | Laipply et al. | |
| 4,902,244 | A * | 2/1990 | Endo et al. | 439/489 |
| 4,911,655 | A | 3/1990 | Pinyan et al. | |
| 4,955,823 | A | 9/1990 | Luzzi | |
| 5,045,656 | A | 9/1991 | Kojima | |
| 5,254,013 | A * | 10/1993 | Tanaka | 439/352 |

(Continued)

FOREIGN PATENT DOCUMENTS

JP S62-198677 12/1987

(Continued)

OTHER PUBLICATIONS

Cooper Power Systems, Loadbreak Apparatus Connectors, 200 A 15 kV Class Loadbreak Bushing Insert, 500-12, Nov. 1995, 2 pages.

(Continued)

*Primary Examiner* — Alexander Gilman
(74) *Attorney, Agent, or Firm* — King & Spalding LLP

(57) ABSTRACT

Separable connector assemblies include one or more pairs of connectors that engage and disengage one another in electrical connection and disconnection operations, respectively. An operator can disengage the connectors by pushing the connectors together and then pulling the connectors apart. Pushing the connectors together shears interface adhesion between the connectors, making it easier for the operator to pull the connectors apart. An indicator integral or coupled to one of the connectors can indicate whether the first and second connectors are in the pushed-in-position. A window in the other connector includes an opening, channel, and/or translucent or semi-translucent material through which the indicator may be seen. The window and/or one or more vents in a tubular member of one of the connectors can include a channel that provides an air path for ingress of air between the connectors, to thereby remove or reduce a vacuum or partial vacuum between the connectors.

21 Claims, 13 Drawing Sheets

U.S. PATENT DOCUMENTS

| | | | | |
|---|---|---|---|---|
| 5,573,410 | A | 11/1996 | Stepniak | |
| 5,641,306 | A * | 6/1997 | Stepniak | 439/491 |
| 5,641,310 | A | 6/1997 | Tiberio, Jr. | |
| 5,655,921 | A | 8/1997 | Makal et al. | |
| 5,676,901 | A | 10/1997 | Higashi et al. | |
| 5,795,180 | A * | 8/1998 | Siebens | 439/489 |
| 5,816,835 | A | 10/1998 | Meszaros | |
| 5,857,862 | A * | 1/1999 | Muench et al. | 439/181 |
| 5,904,887 | A | 5/1999 | Nakamura et al. | |
| 5,912,604 | A | 6/1999 | Harvey et al. | |
| 6,040,538 | A | 3/2000 | French et al. | |
| 6,075,209 | A | 6/2000 | Luzzi | |
| 6,168,447 | B1 | 1/2001 | Stepniak et al. | |
| 6,213,799 | B1 | 4/2001 | Jazowski et al. | |
| 6,302,927 | B1 | 10/2001 | Tanigawa | |
| 6,398,579 | B1 | 6/2002 | Banas et al. | |
| 6,504,103 | B1 | 1/2003 | Meyer et al. | |
| 6,542,056 | B2 | 4/2003 | Nerstrom et al. | |
| 6,796,820 | B2 | 9/2004 | Jazowski et al. | |
| 6,830,475 | B2 | 12/2004 | Jazowski et al. | |
| 6,939,151 | B2 | 9/2005 | Borgstrom et al. | |
| 6,984,791 | B1 | 1/2006 | Meyer et al. | |
| 7,044,760 | B2 | 5/2006 | Borgstrom et al. | |
| 7,044,769 | B2 | 5/2006 | Zhao et al. | |
| 7,104,823 | B2 | 9/2006 | Jazowski et al. | |
| 7,134,889 | B2 | 11/2006 | Hughes et al. | |
| 7,182,647 | B2 | 2/2007 | Muench et al. | |
| 7,304,262 | B2 | 12/2007 | Stoving et al. | |
| 7,384,287 | B2 | 6/2008 | Hughes et al. | |
| 7,397,012 | B2 | 7/2008 | Stepniak et al. | |
| 7,470,131 | B2 | 12/2008 | Hughes | |
| 7,494,355 | B2 | 2/2009 | Hughes et al. | |
| 7,572,133 | B2 | 8/2009 | Hughes et al. | |
| 7,670,162 | B2 | 3/2010 | Hughes | |
| 2002/0168887 | A1 | 11/2002 | Roscizewski et al. | |
| 2006/0160388 | A1 | 7/2006 | Hughes et al. | |
| 2007/0026713 | A1 | 2/2007 | Hughes et al. | |
| 2007/0032110 | A1 | 2/2007 | Hughes et al. | |
| 2007/0097601 | A1 | 5/2007 | Hughes | |
| 2007/0108164 | A1 | 5/2007 | Muench et al. | |
| 2009/0215321 | A1 | 8/2009 | Hughes | |
| 2009/0233472 | A1 | 9/2009 | Hughes | |

FOREIGN PATENT DOCUMENTS

| | | |
|---|---|---|
| JP | S63-93081 | 6/1988 |
| JP | H1-175181 | 7/1989 |
| JP | H4-54164 | 5/1992 |
| JP | 4190605 | 7/1992 |

OTHER PUBLICATIONS

Cooper Power Systems, Loadbreak Apparatus Connectors, 200 A 25 kV Class Rotatable Feedthru Insert, Electrical Apparatus 500-30, Jun. 1999, 2 pages.

Cooper Power Systems, Loadbreak Apparatus Connectors, 200 A 25 kV Class Loadbreak Bushing Insert, Service Inforamtion 500-26, May 2003, 2 pages.

Cooper Power Systems, Loadbreak Apparatus Connectors, 200 A 15 kV Class Loadbreak Rotatable Feedthru Insert, Electrical Apparatus 500-13, Apr. 2001, 2 pages.

Cooper Power Systems, Deadbreak Apparatus Connectors, 600 A 25 kV Class PUSH-OP® Deadbreak Connector, Electrical Apparatus 600-33, Nov. 2004, 4 pages.

Cooper Power Systems, Product Brief, Latched Elbow Indicator, Bulletin 94014, Nov. 1995, 1 page.

Elastimold, STICK-OPerable 600-Amp Connector Systems, For Safe Operation of Deadfront Apparatus, Amerace Corporation, Feb. 1984, 12 pages.

Breakthrough in Switching Technology, G&W Electric Company, Trident, Solid Dielectric Switchgear, Oct. 2001, 8 pages.

LINK-OP™, 600A Operable Connector System, "The missing link between dead-front switchgear and your operating requirements", Elastimold, A Unit of the Utility Products & Services Group, Amerace Corporation, A-894, 1 page.

* cited by examiner

SEPARABLE CONNECTOR SYSTEM WITH A POSITION INDICATOR

RELATED PATENT APPLICATIONS

This patent application is a continuation-in-part application of co-pending U.S. patent application Ser. No. 12/072,513, entitled "Push-Then-Pull Operation of a Separable Connector System," filed Feb. 25, 2008, which is related to co-pending U.S. patent application Ser. No. 12/072,333, entitled "Separable Connector with Interface Undercut," filed Feb. 25, 2008; U.S. patent application Ser. No. 12/072,498, entitled "Separable Connector With Reduced Surface Contact," filed Feb. 25, 2008; U.S. patent application Ser. No. 12/072,164, entitled "Dual Interface Separable Insulated Connector With Overmolded Faraday Cage," filed Feb. 25, 2008; and U.S. patent application Ser. No. 12/072,193, entitled "Method of Manufacturing a Dual Interface Separable Insulated Connector With Overmolded Faraday Cage," filed Feb. 25, 2008. In addition, this patent application is related to co-pending U.S. patent application Ser. No. 12/340,107, entitled "Separable Connector System with Vents in Bushing Nose," filed Dec. 19, 2008. The complete disclosure of each of the foregoing priority and related applications is hereby fully incorporated herein by reference.

TECHNICAL FIELD

The invention relates generally to separable connector systems for electric power systems and more particularly to a separable connector system with a position indicator.

BACKGROUND

In a typical power distribution network, substations deliver electrical power to consumers via interconnected cables and electrical apparatuses. The cables terminate on bushings passing through walls of metal encased equipment, such as capacitors, transformers, and switchgear. Increasingly, this equipment is "dead front," meaning that the equipment is configured such that an operator cannot make contact with any live electrical parts. Dead front systems have proven to be safer than "live front" systems, with comparable reliability and low failure rates.

Various safety codes and operating procedures for underground power systems require a visible disconnect between each cable and electrical apparatus to safely perform routine maintenance work, such as line energization checks, grounding, fault location, and hi-potting. A conventional approach to meeting this requirement for a dead front electrical apparatus is to provide a "separable connector system" including a first connector assembly connected to the apparatus and a second connector assembly connected to an electric cable. The second connector assembly is selectively positionable with respect to the first connector assembly. An operator can engage and disengage the connector assemblies to achieve electrical connection or disconnection between the apparatus and the cable.

Generally, one of the connector assemblies includes a female connector, and the other of the connector assemblies includes a corresponding male connector. In some cases, each of the connector assemblies can include two connectors. For example, one of the connector assemblies can include ganged, substantially parallel female connectors, and the other of the connector assemblies can include substantially parallel male connectors that correspond to and are aligned with the female connectors.

During a typical electrical connection operation, an operator slides the female connector(s) over the corresponding male connector(s). To assist with this operation, the operator generally coats the connectors with a lubricant, such as silicone. Over an extended period of time, the lubricant hardens, bonding the connectors together. This bonding makes it difficult to separate the connectors in an electrical disconnection operation. The greater the surface area of the connectors, the more difficult the connection is to break. This problem is greatly exacerbated when the separable connector system includes multiple connector pairs that must be separated simultaneously.

Conventionally, operators have attempted to overcome this problem by twisting one of the connector assemblies with a liveline tool prior to separating the connectors. The twisting operation can shear interface adhesion between the connectors, allowing the operator to more easily separate the connectors. There are many drawbacks to this approach. For example, the twisting operation may deform the connector assemblies by loosening and unthreading current carrying joints and/or twisting and bending an operating eye of the connector assemblies. This deformation of the connector assemblies can render the connector assemblies ineffective and/or unsafe. In addition, the ergonomics of the twisting operation may result in immediate and long term (i.e., repetitive motion) injury to the operator. Moreover, connector assemblies with multiple, substantially parallel connectors cannot be twisted to break interface adhesion.

Therefore, a need exists in the art for a system and method for safely and easily separating connector assemblies of a separable connector system. In particular, a need exists in the art for a system and method for safely and easily reducing or shearing interface adhesion between connectors of a separable connector system. In addition, a need exists in the art for a system and method for reducing or shearing interface adhesion between connectors of multiple substantially parallel connector pairs of a separable connector system.

SUMMARY

The invention provides systems and methods for separating connector assemblies of a separable connector system. The separable connector assemblies include one or more pairs of connectors configured to engage and disengage one another in electrical connection and disconnection operations, respectively. For example, an operator can selectively engage and disengage the connectors to make or break an energized connection in a power distribution network.

In one exemplary aspect of the invention, a first connector assembly is connected to a dead front or live front electrical apparatus, such as a capacitor, transformer, switchgear, or other electrical apparatus. A second connector assembly is connected to a power distribution network via a cable. Joining the connectors of the first and second connector assemblies together closes a circuit in the power distribution network. Similarly, separating the connectors opens the circuit.

For each pair of connectors, a first of the connectors can include a housing disposed substantially about a recess from which a probe extends. For example, the probe can include a conductive material configured to engage a corresponding conductive contact element of a second of the pair of connectors. The second connector can include a tubular housing disposed substantially about the conductive contact element and at least a portion of a tubular member, such as a piston holder, coupled to the conductive contact element. A nose piece can be secured to an end of the tubular housing, proximate a "nose end" of the second connector. The nose piece can be configured to be disposed within the recess of the first connector when the connectors are connected. An outer shoulder of the second connector can be coupled to the tubular housing.

In one exemplary aspect of the invention, an operator can separate the connectors by pushing the connectors together and then pulling the connectors apart. Pushing the connectors together can shear interface adhesion between the connectors, making it easier for the operator to pull the connectors apart. It also can provide a "running start" for overcoming a latching force between the connectors when pulling the connectors apart. For example, relative movement between the connectors during the push portion of this "push-then-pull" operation can be about 0.1 inches to more than 1.0 inches or between about 0.2 inches and 1.0 inches.

The connectors can include clearance regions sized and configured to accommodate this relative movement. For example, the connectors can include a "nose clearance" region sized and configured to accommodate relative movement of the nose end of the second connector and the recess of the first connector during a push-then-pull operation of the first and second connectors. The connectors also may include a "shoulder clearance" region sized and configured to accommodate relative movement of the shoulder of the second connector and the housing of the first connector during the push-then-pull operation. In addition, the connectors may include a "probe clearance" region sized and configured to accommodate relative movement of the probe of the first connector and the tubular member of the second connector during the push-then-pull operation.

In another exemplary aspect of the invention, the connectors can include a latching mechanism for securing the connectors together when they are in a connected operating position. For example, one of the connectors can include a groove, and the other of the connectors can include a latching element configured to engage the groove when the connectors are in the connected operating position. The latching element can include a locking ring, a projection of a finger contact element, such as a finger of the conductive contact element of the second connector, or another securing element apparent to a person of ordinary skill in the art having the benefit of the present disclosure. Similar to the clearance regions described above, the connectors can include a clearance region sized and configured to accommodate relative movement of the groove and the latching element during a push-then-pull operation to disconnect the connectors.

In yet another exemplary aspect of the invention, the nose end of the second connector can include an undercut segment configured not to engage an interior surface of the housing of the first connector when the connectors are engaged. For example, the housing can include a semi-conductive material extending along an interior portion of an inner surface of the housing. Other (non-undercut) segments of the second connector may engage the inner surface of the housing when the connectors are engaged. For example, the undercut segment can be disposed between two "interface segments" configured to engage the interior surface of the first connector when the connectors are engaged. Limiting the surface area of the nose end that interfaces with the interior surface of the other connector reduces surface adhesion and a pressure drop when separating the connectors, making separation easier to perform. For example, the undercut segment can be disposed within the nose piece of the second connector.

In yet another exemplary aspect of the invention, a separable connector system includes first and second connectors that are selectively positionable relative to one another to open and close a circuit. Similarly to the connectors described above, the first and second connectors are sized and configured to accommodate a push-then-pull operation of the first and second connectors from an operating position to a pushed-in-position and from the pushed-in position to a released position to open the circuit. The separable connector system includes an indicator configured to indicate whether the first and second connectors are in the pushed-in-position. In particular, the indicator provides an operator with a visual indication of whether the connectors are in the operating position or the pushed-in-position.

The indicator may be integral to, or coupled to, one of the connectors. For example, the indicator may include a ring disposed around at least a portion of one of the connectors. The indicator can include a material that is visible to the operator when the connectors are in the pushed-in position but that is not visible when the connectors are in the operating position. For example, one of the connectors can include a window through which the indicator is visible when the connectors are in the pushed-in position, and through which the indicator is not visible when the connectors are in the operating position.

The window can include an opening, channel, and/or translucent or semi-translucent material, such as clear plastic or clear rubber, through which the indicator may be seen. According to one aspect, the window can include a channel that extends at least partially through one of the connectors. The channel can provide an air path that allows ingress of air through the channel and at least partially between the first and second connectors during the push-then-pull operation. This ingress of air can remove or reduce a vacuum or partial vacuum between the connectors, thereby reducing risk of flashover and also reducing the operating force required to separate the connectors during the push-then-pull operation.

In addition to, or instead of, the channel in the window, a tubular member of one of the connectors can include one or more vents for allowing ingress of air between the connectors. The other of the connectors can include a probe configured to be at least partially received within the tubular member. The connectors can include a clearance region sized and configured to accommodate relative movement of the probe and the tubular member during a push-then-pull operation of the first and second connectors to open a circuit. Each vent can include a channel that provides an air path that allows the ingress of air through the channel and into the clearance region during the push-then-pull operation.

These and other aspects, objects, features, and advantages of the invention will become apparent to a person having ordinary skill in the art upon consideration of the following detailed description of illustrated exemplary embodiments, which include the best mode of carrying out the invention as presently perceived.

DETAILED DESCRIPTION OF EXEMPLARY EMBODIMENTS

The invention is directed to systems and methods for safely and easily separating connector assemblies of a separable connector system. In particular, the invention is directed to systems and methods for safely and easily reducing or shearing interface adhesion between connectors of a separable connector system using a push-then-pull operation or a reducing surface contact between the connectors. The separable connector assembly includes one or more pairs of separable connectors configured to engage one another in an electrical connection operation and to disengage one another in an electrical disconnection operation. An operator can disengage the connectors during the electrical disconnection operation by pushing the connectors together and then pulling the connectors apart. Pushing the connectors together shears interface adhesion between the connectors, making it easier for the operator to pull the connectors apart.

Turning now to the drawings, in which like numerals indicate like elements throughout the figures, exemplary embodiments of the invention are described in detail.

Figure 1:
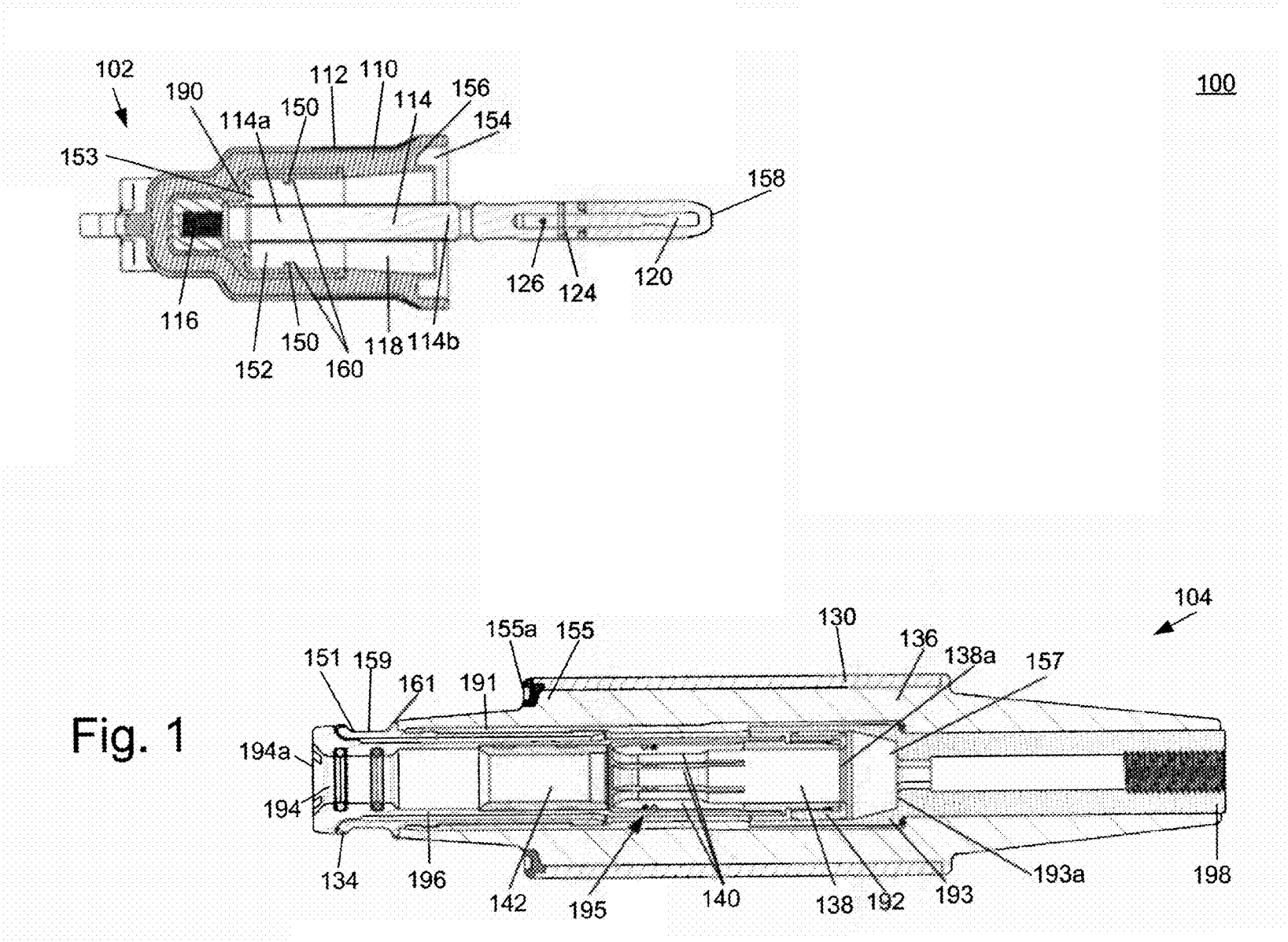
FIG. 1 is a longitudinal cross-sectional view of a separable connector system, according to certain exemplary embodiments.

FIG. 1 is a longitudinal cross-sectional view of a separable connector system 100, according to certain exemplary embodiments. The system 100 includes a female connector 102 and a male connector 104 configured to be selectively engaged and disengaged to make or break an energized connection in a power distribution network. For example, the male connector 104 can be a bushing insert or connector connected to a live front or dead front electrical apparatus (not shown), such as a capacitor, transformer, switchgear, or other electrical apparatus. The female connector 102 can be an elbow connector or other shaped device electrically connected to the power distribution network via a cable (not shown). In certain alternative exemplary embodiments, the female connector 102 can be connected to the electrical apparatus, and the male connector 104 can be connected to the cable.

The female connector 102 includes an elastomeric housing 110 comprising an insulative material, such as ethylene-propylene-dienemonomoer ("EPDM") rubber. A conductive shield layer 112 connected to electrical ground extends along an outer surface of the housing 110. A semi-conductive material 190 extends along an interior portion of an inner surface of the housing 110, substantially about a portion of a cup shaped recess 118 and conductor contact 116 of the female connector 102. For example, the semi-conductive material 190 can included molded peroxide-cured EPDM configured to control electrical stress. In certain exemplary embodiments, the semi-conductive material 190 can act as a "faraday cage" of the female connector 102.

One end 114*a* of a male contact element or probe 114 extends from the conductor contact 116 into the cup shaped recess 118. The probe 114 comprises a conductive material, such as copper. The probe 114 also comprises an arc follower 120 extending from an opposite end 114*b* thereof. The arc follower 120 includes a rod-shaped member of ablative material. For example, the ablative material can include acetal co-polymer resin loaded with finely divided melamine. In certain exemplary embodiments, the ablative material may be injection molded on an epoxy bonded glass fiber reinforcing pin (not shown) within the probe 114. A recess 124 is provided at the junction between the probe 114 and the arc follower 120. An aperture 126 is provided through the end 114*b* of the probe 114 for assembly purposes.

The male connector 104 includes a semi-conductive shield 130 disposed at least partially about an elongated insulated body 136. The insulated body 136 includes elastomeric insulating material, such as molded peroxide-cured EPDM. A conductive shield housing 191 extends within the insulated body 136, substantially about a contact assembly 195. A non-conductive nose piece 134 is secured to an end of the shield housing 191, proximate a "nose end" 194 of the male connector 104. The elastomeric insulating material of the insulated body 136 surrounds and bonds to an outer surface of the shield housing 191 and to a portion of the nose piece 134.

The contact assembly 195 includes a female contact 138 with deflectable fingers 140. The deflectable fingers 140 are configured to at least partially receive the arc follower 120 of the female connector 102. The contact assembly 195 also includes an arc interrupter 142 disposed proximate the deflectable fingers 140. The contact assembly 195 is disposed within a contact tube 196.

The female and male connectors 102, 104 are operable or matable during "loadmake," "loadbreak," and "fault closure" conditions. Loadmake conditions occur when one of the contacts 114, 138 is energized and the other of the contacts 114, 138 is engaged with a normal load. An arc of moderate intensity is struck between the contacts 114, 138 as they approach one another and until joinder of the contacts 114, 138.

Loadbreak conditions occur when mated male and female contacts 114, 138 are separated when energized and supplying power to a normal load. Moderate intensity arcing occurs between the contacts 114, 138 from the point of separation thereof until they are somewhat removed from one another. Fault closure conditions occur when the male and female contacts 114, 138 are mated with one of the contacts being energized and the other of the contacts being engaged with a load having a fault, such as a short circuit condition. In fault closure conditions, substantial arcing occurs between the contacts 114, 138 as they approach one another and until they are joined in mechanical and electrical engagement.

In accordance with known connectors, the arc interrupter 142 of the male connector 104 may generate arc-quenching gas for accelerating the engagement of the contacts 114, 138. For example, the arc-quenching gas may cause a piston 192 of the male connector 104 to accelerate the female contact 138 in the direction of the male contact 114 as the connectors 102, 104 are engaged. Accelerating the engagement of the contacts 114, 138 can minimize arcing time and hazardous conditions during loadmaker and fault closure conditions. In certain exemplary embodiments, the piston 192 is disposed within the shield housing 191, between the female contact 138 and a piston holder 193. For example, the piston holder 193 can include a tubular, conductive material, such as copper, extending from an end 138*a* of the female contact 138 to a rear end 198 of the elongated body 136.

The arc interrupter 142 is sized and dimensioned to receive the arc follower 120 of the female connector 102. In certain exemplary embodiments, the arc interrupter 142 can generate arc-quenching gas to extinguish arcing when the contacts 114, 138 are separated. Similar to the acceleration of the contact engagement during loadmaker and fault closure conditions, generation of the arc-quenching gas can minimize arcing time and hazardous conditions during loadbreak conditions.

In certain exemplary embodiments, the female connector 102 includes a locking ring 150 protruding from the cup shaped recess 118, substantially about the end 114*a* of the probe 114. A locking groove 151 in the nose piece 134 of the male connector 104 is configured to receive the locking ring 150 when the male and female connectors 102, 104 are engaged. An interference fit or "latching force" between the locking groove 151 and the locking ring 150 can securely mate the male and female connectors 102, 104 when the connectors 102, 104 are electrically connected. An operator must overcome this latching force when separating the male and female connectors 102, 104 during an electrical disconnection operation. A person of ordinary skill in the art having the benefit of the present disclosure will recognize that many other suitable means exist for securing the connectors 102, 104. For example, a "barb and groove" latch, described below with reference to FIG. 2, may be used to secure the connectors 102, 104.

To assist with an electrical connection operation, an operator can coat a portion of the female connector 102 and or a portion of the male connector 104 with a lubricant, such as silicone. Over an extended period of time, the lubricant may harden, bonding the connectors 102, 104 together. This bonding can make it difficult to separate the connectors 102, 104 in an electrical disconnection operation. The operator must overcome both the latching force of the locking ring 150 and locking groove 151 and interface adhesion between the connectors 102, 104 caused by the hardened lubricant to separate the connectors 102, 104.

The separable connector system 100 of FIG. 1 allows the operator to safely and easily overcome the latching force and interface adhesion using a push-then-pull operation. Instead of pulling the connectors 102, 104 apart from their ordinary engaged operating position, as with traditional connector systems, the operator can push the connectors 102, 104 further together prior to pulling the connectors 102, 104 apart. Pushing the connectors 102, 104 together can shear the interface adhesion between the connectors 102, 104, making it easier for the operator to pull the connectors 102, 104 apart. It also can provide a "running start" for overcoming the latching force when pulling the connectors 102, 104 apart.

Each of the connectors 102, 104 is sized and configured to accommodate the push-then-pull operation. First, the cup-shaped recess 118 of the female connector 102 includes a "nose clearance" region 152 sized and configured to accommodate relative movement of the nose end 194 of the male connector 104 and the cup-shaped recess 118 during the push-then-pull operation. For example, the nose end 194 and/or the cup-shaped recess 118 can move along an axis of the probe 114, with the nose end 194 being at least partially disposed within the nose clearance region 152. In certain exemplary embodiments, an edge 194*a* of the nose end 194 can abut an end 153 of the cup shaped recess 118, within the nose clearance region 152, when the push portion of the push-then-pull operation is completed, i.e., when the connectors 102, 104 are completely pushed together. For example, an edge of the contact tube 196 and/or an edge of the nose piece 134, proximate the nose end 194 of male connector 104, can abut the end 153 of the cup shaped recess 118 when the push portion of the push-then-pull operation is completed.

Second, the housing 110 of the female connector 102 includes a "shoulder clearance" region 154 sized and configured to accommodate relative movement of a shoulder 155 of the male connector 104 and the housing 110 of the female connector 102 during the push-then-pull operation. For example, the shoulder 155 and/or the housing 110 can move along an axis parallel to the axis of the probe 114, with the shoulder 155 being at least partially disposed within the shoulder clearance region 154. In certain exemplary embodiments, an end 155*a* of the shoulder 155 can abut an end 156 of the housing 110, within the shoulder clearance region 154, when the push portion of the push-then-pull operation is completed.

Third, the piston holder 193 of the male connector 104 includes a "probe clearance" region 157 sized and configured to accommodate relative movement of the piston holder 193 and the probe 114 of the female connector 102 during the push-then-pull operation. For example, the probe 114 and/or piston holder 193 can move along an axis of the probe 114, with the probe 114 being at least partially disposed within the probe clearance region 157. In certain exemplary embodiments, an end 158 of the arc follower 120 of the probe 114 can abut an end 193*a* of the piston holder 193, within the probe clearance region 157, when the push portion of the push-then-pull operation is completed.

Fourth, the locking groove 151 in the nose piece 134 of the male connector 104 includes a "latching clearance" region 159 sized and configured to accommodate relative movement of the locking ring 150 of the female connector 102 and the locking groove 151 during the push-then-pull operation. For example, the locking ring 150 and/or locking groove 151 can move along an axis parallel to the axis of the probe 114, with the locking ring 150 being at least partially disposed within the latching clearance region 159. In certain exemplary embodiments, an end 160 of the locking ring 150 can abut an end 161 of the latching groove 151, within the latching clearance region 159, when the push portion of the push-then-pull operation is completed. In certain alternative exemplary embodiments (not illustrated in FIG. 1), the male connector 104 can include a locking ring 150, and the female connector 102 can include a locking groove 151 and latching clearance region 159.

A person of ordinary skill in the art having the benefit of the present disclosure will recognize that the clearances described herein are merely exemplary in nature and that other suitable clearances and other suitable means exist for accommodating relative movement between the connectors during a push-then-pull operation.

The relative movement of the connectors 102, 104 during the push-then-pull operation can vary depending on the sizes of the connectors 102, 104 and the strength of the interface adhesion to be sheared when separating the connectors 102, 104. For example, in certain exemplary embodiments, the relative movement of the connectors 102, 104 during the push portion of the push-then-pull operation can be on the order of about 0.1 inches to about 1.0 or more inches. One or both of the connectors 102, 104 can move during the push-then-pull operation. For example, one of the connectors 102, 104 can remain stationary while the other of the connectors 102, 104 moves towards and away from the stationary connector 102, 104. Alternatively, both connectors 102, 104 can move towards and away from one another.

Figure 2:
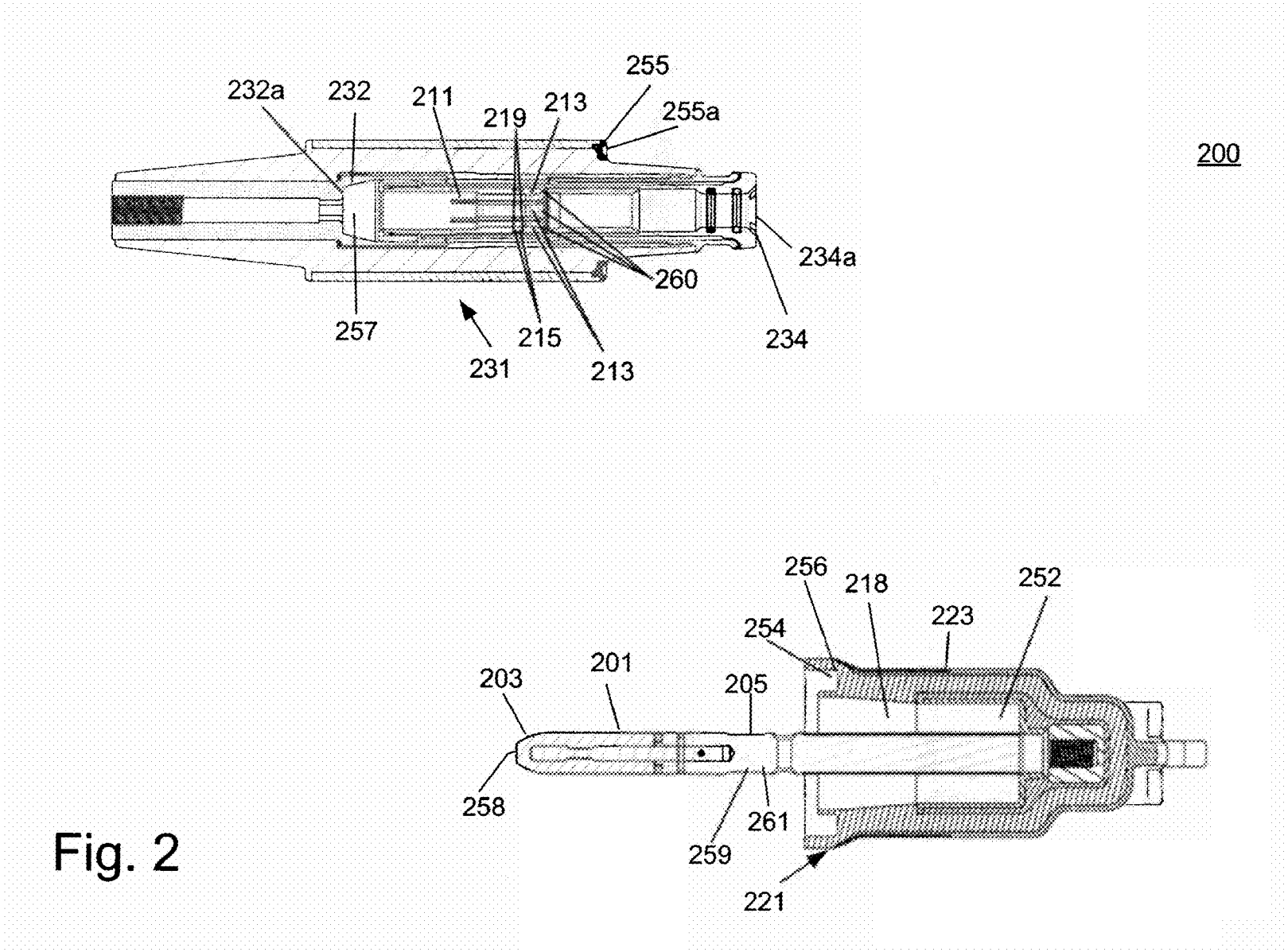
FIG. 2 is a longitudinal cross-sectional view of a separable connector system, according to certain alternative exemplary embodiments.

FIG. 2 is a longitudinal cross-sectional view of a separable connector system 200, according to certain alternative exemplary embodiments. The system 200 includes a female connector 221 and a male connector 231 configured to be selectively engaged and disengaged to make or break an energized connection in a power distribution network. The female and male connectors 221, 231 are substantially similar to the female and male connectors 102, 104, respectively, of the system 100 of FIG. 1, except that the connectors 221, 231 of FIG. 2 include a different probe 201 and latching mechanism than the probe and (ring and groove) latching mechanism of the connectors 102, 104 of FIG. 1.

The probe 201 includes a substantially cylindrical member with a recessed tip 203 near a first end of the probe 201. For example, the cylindrical member can include a rod or a tube. In a circuit closing operation, the recessed tip 203 penetrates into and connects with finger contacts 211 of the male connector 231.

The probe 201 includes a recessed area 205, which provides a contact point for interlocking the probe 201 with the finger contacts 211 when the male and female connectors 221, 231 are connected. A first end of each finger contact 211 includes a projection 213 configured to provide a contact point for each finger contact 211 to interlock with the recessed area 205. For example, as the probe 201 is inserted into the finger contacts 211 during an electrical connection operation, the probe 201 can slide into the finger contacts 211 by riding on the projection 213 of each finger contact 211.

Each projection 213 includes a rounded front face and a backside including a ridge angled steeper than the rounded front face. The ridge of the projection 213 is sloped closer to perpendicular to an axis of motion of the probe 201 than the rounded front face of the projection 213. The rounded front face of the projection 213 allows the probe 201 to slide into the finger contacts 211 with minimal resistance and reduced friction. The ridge on the backside of the projection 213 latches the probe 201 into the finger contacts 211. Upon seating of the probe 201 within the finger contacts 211, the ridge of the projection 213 locks into the recessed area 205. The steeper angle of the ridge causes a greater force to be required to remove the probe 201 from the finger contacts 211 than to insert the probe 201 into the finger contacts 211.

When the probe 201 is inserted into the finger contacts 211, the finger contacts 211 expand outwardly to accommodate the probe 201. In certain exemplary embodiments, an external surface of each finger contact 211 includes at least one recessed groove 219 configured to house at least one expandable retention spring 215. The expandable retention springs 215 are configured to restrict flexibility of the finger contacts 211, thereby increasing contact pressure of each finger contact 211. For example, each retention spring 215 can include a flexible, substantially circular member configured to expand or contract based on an applied force.

As with the separable connector system 100 of FIG. 1, the separable connector system 200 of FIG. 2 allows the operator to safely and easily separate the connectors 221, 231 using a push-then-pull operation. Each of the connectors 221, 231 is sized and configured to accommodate the push-then-pull operation. First, as with the separable connector system 100 of FIG. 1, a cup-shaped recess 218 of the female connector 221 includes a "nose clearance" region 252 sized and configured to accommodate relative movement of a nose end 234 of the male connector 231 and the cup-shaped recess 218 during the push-then-pull operation. For example, the nose end 234 and/or the cup-shaped recess 218 can move along an axis of the probe 201, with the nose end 234 being at least partially disposed within the nose clearance region 252. In certain exemplary embodiments, an edge 234*a* of the nose end 234 can abut an end 253 of the cup shaped recess 218, within the nose clearance region 252, when the push portion of the push-then-pull operation is completed, i.e., when the connectors 221, 231 are completely pushed together.

Second, a housing 223 of the female connector 221 includes a "shoulder clearance" region 254 sized and configured to accommodate relative movement of a shoulder 255 of the male connector 231 and the housing 223 of the female connector 221 during the push-then-pull operation. For example, the shoulder 255 and/or the housing 223 can move along an axis parallel to the axis of the probe 201, with the shoulder 255 being at least partially disposed within the shoulder clearance region 254. In certain exemplary embodiments, an end 255*a* of the shoulder 255 can abut an end 256 of the housing 223, within the shoulder clearance region 254, when the push portion of the push-then-pull operation is completed.

Third, a piston holder 232 of the male connector 231 includes a "probe clearance" region 257 sized and configured to accommodate relative movement of the piston holder 232 and the probe 201 of the female connector 221 during the push-then-pull operation. For example, the probe 201 and/or piston holder 232 can move along an axis of the probe 201, with the probe 201 being at least partially disposed within the probe clearance region 257. In certain exemplary embodiments, an end 258 of the probe 201 can abut an end 232*a* of the piston holder 232, within the probe clearance region 257, when the push portion of the push-then-pull operation is completed.

Fourth, the recessed area 205 of the probe 201 includes a "latching clearance" region 259 sized and configured to accommodate relative movement of the recessed area 205 and the finger contacts 211 of the male connector 231 during the push-then-pull operation. For example, the recessed area 205 and/or finger contacts 211 can move along an axis of the probe 201, with the finger contacts 211 being at least partially disposed within the latching clearance region 259. In certain exemplary embodiments, an end 260 of each finger contact 211 can abut an end 261 of the recessed area 205, within the latching clearance region 259, when the push portion of the push-then-pull operation is completed.

A person of ordinary skill in the art having the benefit of the present disclosure will recognize that the clearances described herein are merely exemplary in nature and that other suitable clearances and other suitable means exist for accommodating relative movement between the connectors during a push operation.

The relative movement of the connectors 221, 231 during the push-then-pull operation can vary depending on the sizes of the connectors 221, 231 and the strength of the interface adhesion to be sheared when separating the connectors 221, 231. For example, in certain exemplary embodiments, the relative movement of the connectors 221, 231 during the push portion of the push-then-pull operation can be on the order of about 0.1 inches to about 1.0 or more inches or between about 0.2 inches and 1.0 inches. One or both of the connectors 221, 231 can move during the push-then-pull operation. For example, one of the connectors 221, 231 can remain stationary while the other of the connectors 221, 231 moves towards and away from the stationary connector 221, 231. Alternatively, both connectors 221, 231 can move towards and away from one another.

Figure 3:
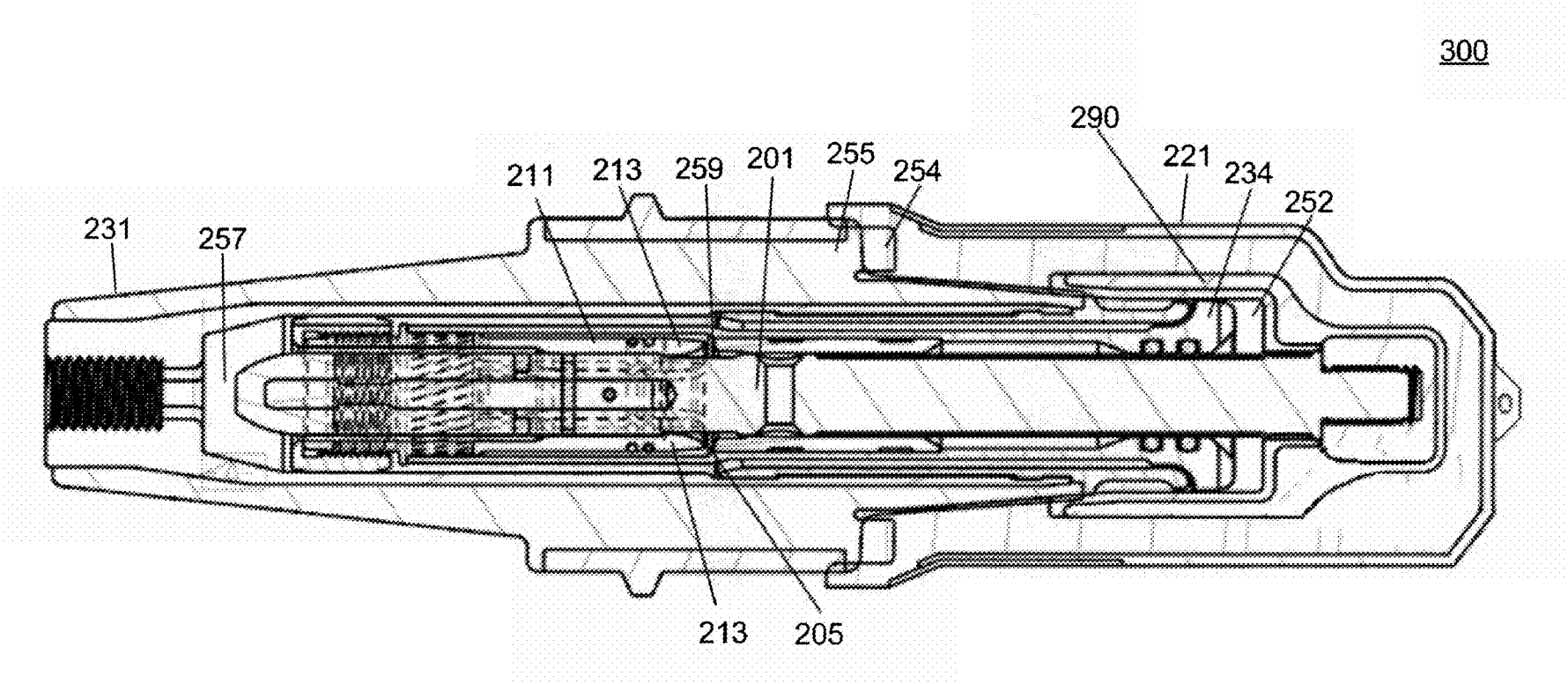
FIG. 3 is a longitudinal cross-sectional view of the separable connector system of FIG. 2 in an electrically connected operating position, according to certain exemplary embodiments.
Figure 4:
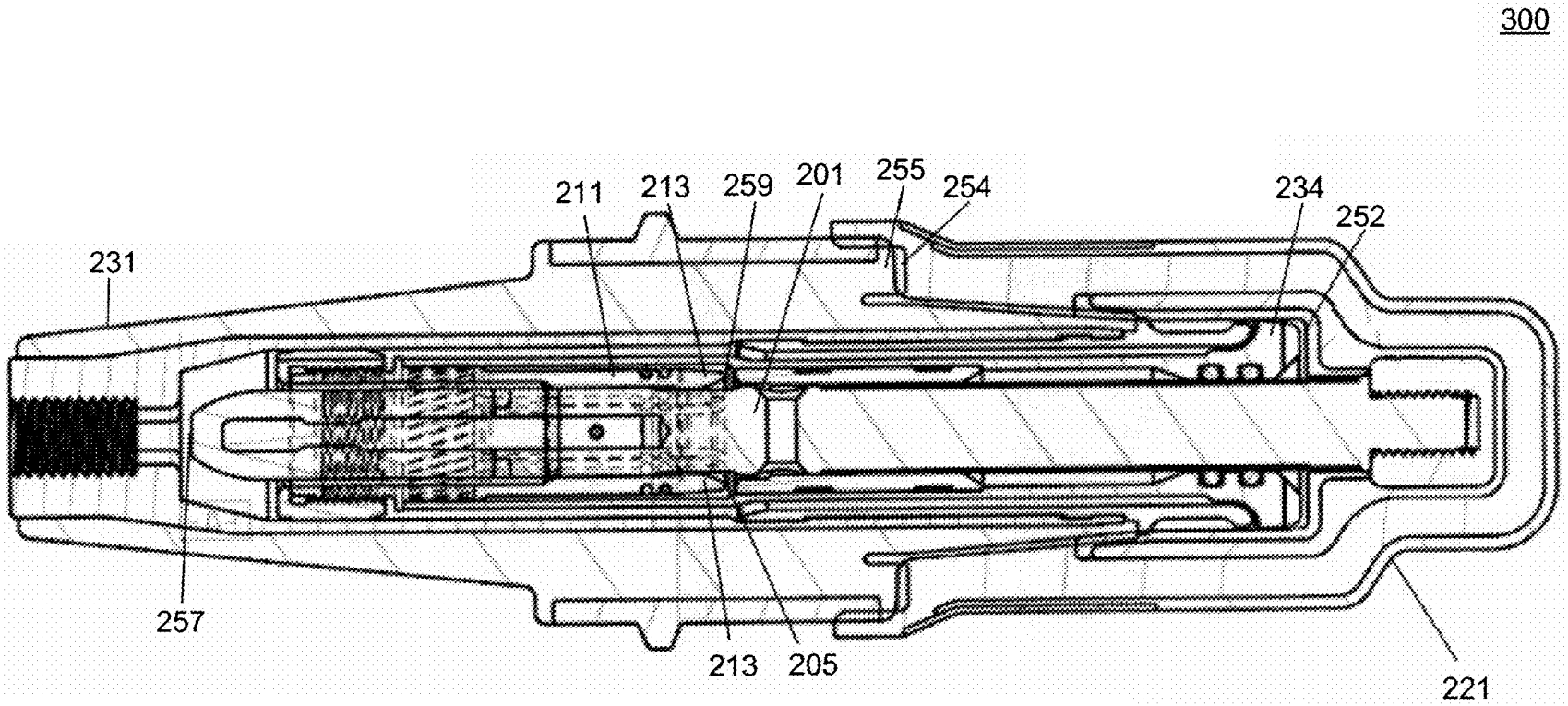
FIG. 4 is a longitudinal cross-sectional view of the separable connector system of FIG. 2 in a pushed-in position, according to certain exemplary embodiments.

FIG. 3 is a longitudinal cross-sectional view of a separable connector system 300 similar to the separable connector system 200 of FIG. 2 in an electrically connected operating position, according to certain exemplary embodiments. FIG. 4 is a longitudinal cross-sectional view of the separable connector system 300 of FIG. 3 in a pushed-in position, according to certain exemplary embodiments.

In the electrically connected operating position depicted in FIG. 3, the female and male connectors 221, 231 are electrically and mechanically engaged. Each projection 213 of the finger contacts 211 of the male connector 231 is interlocked with the recessed area 205 of the probe 201 of the female connector 221. Clearance regions 252, 254, 257, 259 of the connectors 221, 231 are sized and configured to accommodate a push-then-pull operation of the connectors 221, 231, substantially as described above with reference to FIG. 2.

An operator can move one or both of the connectors 221, 231 together to the pushed-in position depicted in FIG. 4. In the pushed-in position, the connectors 221, 231 are more closely interfaced than in the operating position depicted in FIG. 3, with portions of each clearance region 252, 254, 257, 259 being substantially filled. In particular, a portion of the nose end 234 of the male connector 231 is at least partially disposed within the nose clearance region 252; a portion of the shoulder 255 of the male connector 231 is at least partially disposed within the shoulder clearance region 254; a portion of the probe 201 of the female connector 221 is at least partially disposed within the probe clearance region 257; and a portion of each finger contact 211 of the male connector 231 is at least partially disposed within the latching clearance region 259. For example, in the pushed-in position, the connectors 221, 231 can engage one another in an interference fit, with no air or only minimal air present in the clearance regions 252, 254, 257, 259. In certain exemplary embodiments, the nose end 234 of the male connector 231 is at least partially disposed within a faraday cage 190 of the female connector 221. The faraday cage includes a semi-conductive material, such as molded peroxide-cured EPDM, configured to control electrical stress.

Pushing the connectors together, to the pushed-in position depicted in FIG. 4, can shear interface adhesion present between the connectors 221, 231 in the operating position depicted in FIG. 3 (hereinafter the "resting position"). Shearing the interface adhesion can make it easier for the operator to separate the connectors 221, 231 during an electrical disconnection operation. In particular, the force required to separate the connectors 221, 231 after pushing the connectors together can be less than the force required to separate the connectors 221, 231 from the resting position. In addition, the distance between the pushed-in position and the resting position can provide a "running start" for overcoming latching force between the finger contacts 21 and the recessed area 205 of the probe 201.

Figure 5:
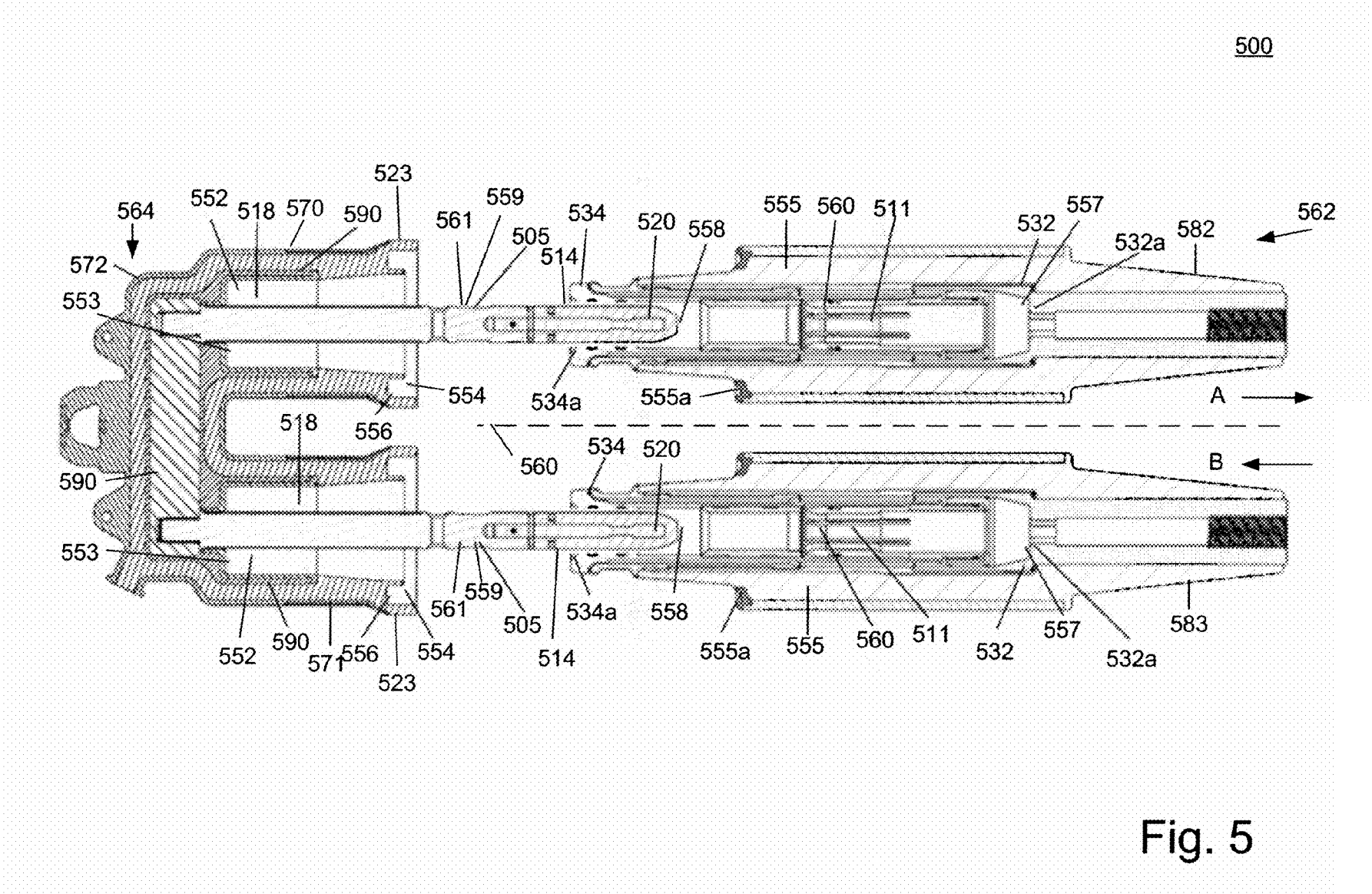
FIG. 5 is a longitudinal cross-sectional view of a separable connector system, according to certain additional alternative exemplary embodiments.

FIG. 5 is a longitudinal cross-sectional view of a separable connector system 500, according to certain additional alternative exemplary embodiments. The separable connector system 500 includes a male connector assembly 562 and a female connector assembly 564 selectively positionable with respect to the male connector assembly 562. An operator can engage and disengage the connector assemblies 562, 564 to make or break an energized connection in a power distribution network.

The female connector assembly 564 includes ganged female connectors 570, 571 that each may be, for example, similar to the female connector 102 illustrated in FIG. 1 and/or the female connector 221 illustrated in FIGS. 2-4. The female connectors 570, 571 are joined to one another by a connecting housing 572 and are electrically interconnected in series via a bus 590. The female connectors 570, 571 are substantially aligned in parallel with one another on opposite sides of a central longitudinal axis of the system 560. As such, probes 514 and arc followers 520 of the female connectors 570 and 571 are aligned in parallel fashion about the axis 560.

In certain exemplary embodiments, the male connector assembly 562 includes stationary male connectors 582, 583 that correspond to and are aligned with the female connectors 570, 571. For example, each of the male connectors 582, 583 may be similar to the male connector 104 shown in FIG. 1 and/or the male connector 231 shown in FIG. 2. In certain exemplary embodiments, one of the male connectors 582, 583 may be connected to a dead front electrical apparatus (not shown), and the other of the male connectors 582, 583 may be connected to a power cable (not shown) in a known manner. For example, one of the male connectors 582, 583 may be connected to a vacuum switch or interrupter assembly (not shown) that is part of the dead front electrical apparatus.

In certain exemplary embodiments, the male connectors 582, 583 can be mounted in a stationary manner to the dead front electrical apparatus. For example, the male connectors 582, 583 may be mounted directly to the dead front electrical apparatus or via a separate mounting structure (not shown). The male connectors 582, 583 are maintained in a spaced apart manner, aligned with the female connectors 570, 571 such that, when the female connectors 570, 571 are moved along the longitudinal axis 560 in the direction of arrow A, the male connectors 582, 583 may be securely engaged to the respective female connectors 570, 571. Likewise, when the female connectors 570, 571 are moved in the direction of arrow B, opposite to the direction of arrow A, the female connectors 570, 571 may be disengaged from the respective male connectors 582, 583 to a separated position.

In certain alternative exemplary embodiments, the female connector assembly 564 may be mounted in a stationary manner to the dead front electrical apparatus, with the male connector assembly 562 being selectively movable relative to the female connector assembly 564. Similarly, in certain additional alternative exemplary embodiments, both the female connector assembly 564 and the male connector assembly 562 may be movable with respect to one another.

The separable connector system 500 of FIG. 5 allows the operator to safely and easily separate the connector assemblies 562, 564 using a push-then-pull operation. Each of the connector assemblies 562, 564 and their corresponding connectors 570, 571, 582, 583 is sized and configured to accommodate the push-then-pull operation. First, as with the separable connector systems 100, 200 of FIGS. 1 and 2, respectively, a cup-shaped recess 518 of each female connector 570, 571 includes a "nose clearance" region 552 sized and configured to accommodate relative movement of a nose end 534 of its corresponding male connector 582, 583 and the cup-shaped recess 518 during the push-then-pull operation. For example, each nose end 534 and/or cup-shaped recess 518 can move along an axis of its corresponding probe 514, with the nose end 534 being at least partially disposed within its corresponding nose clearance region 552. In certain exemplary embodiments, an edge 534*a* of each nose end 534 can abut an end 553 of its corresponding cup shaped recess 518, within the nose clearance region 552, when the push portion of the push-then-pull operation is completed, i.e., when the connector assemblies 562, 564 are completely pushed together. In certain exemplary embodiments, each nose end 534 is at least partially disposed within a faraday cage 590 of the corresponding female connector 570, 571. The faraday cage includes a semi-conductive material, such as molded peroxide-cured EPDM, configured to control electrical stress.

Second, a housing 523 of each female connector 570, 571 includes a "shoulder clearance" region 554 sized and configured to accommodate relative movement of the housing 523 of the female connector 570, 571 and a shoulder 555 of its corresponding male connector 582, 583 during the push-then-pull operation. For example, the shoulder 555 and/or the housing 523 can move along an axis parallel to the axis of its corresponding probe 514, with each shoulder 555 being at least partially disposed within its corresponding shoulder clearance region 554. In certain exemplary embodiments, an end 555*a* of each shoulder 555 can abut an end 556 of its corresponding housing 523, within the shoulder clearance region 554, when the push portion of the push-then-pull operation is completed.

Third, a piston holder 532 of each male connector 582, 583 includes a "probe clearance" region 557 sized and configured to accommodate relative movement of the piston holder 532 and the probe 514 of the male connector's corresponding female connector 570, 571 during the push-then-pull operation. For example, each probe 514 and/or piston holder 532 can move along an axis of the probe 514, with the probe 514 being at least partially disposed within the probe clearance region 557. In certain exemplary embodiments, an end 558 of each probe 514 can abut an end 532*a* of its corresponding piston holder 532, within the probe clearance region 557, when the push portion of the push-then-pull operation is completed.

Fourth, a recessed area 505 of each probe 514 includes a "latching clearance" region 559 sized and configured to accommodate relative movement of the recessed area 505 and finger contacts 511 of the probe's corresponding male connector 582, 583 during the push-then-pull operation. For example, the recessed area 505 and/or finger contacts 511 can move along an axis of the probe 514, with the finger contacts 511 being at least partially disposed within the latching clearance region 559. In certain exemplary embodiments, an end 560 of each finger contact 511 can abut an end 561 of its corresponding recessed area 505, within the latching clearance region 559, when the push portion of the push-then-pull operation is completed.

A person of ordinary skill in the art having the benefit of the present disclosure will recognize that the clearances described herein are merely exemplary in nature and that other suitable clearances and other suitable means exist for accommodating relative movement between the connector assemblies 562, 564 during a push operation.

The relative movement of the connector assemblies 562, 564 during the push-then-pull operation can vary depending on the sizes of the connector assemblies 562, 564 and their corresponding connectors 570, 571, 582, 583, and the strength of the interface adhesion to be sheared when separating the connector assemblies 562, 564. For example, in certain exemplary embodiments, the relative movement of the connector assemblies 562, 564 during the push portion of the push-then-pull operation can be on the order of about 0.1 inches to about 1.0 or more inches or between about 0.2 inches and 1.0 inches.

Figure 6:
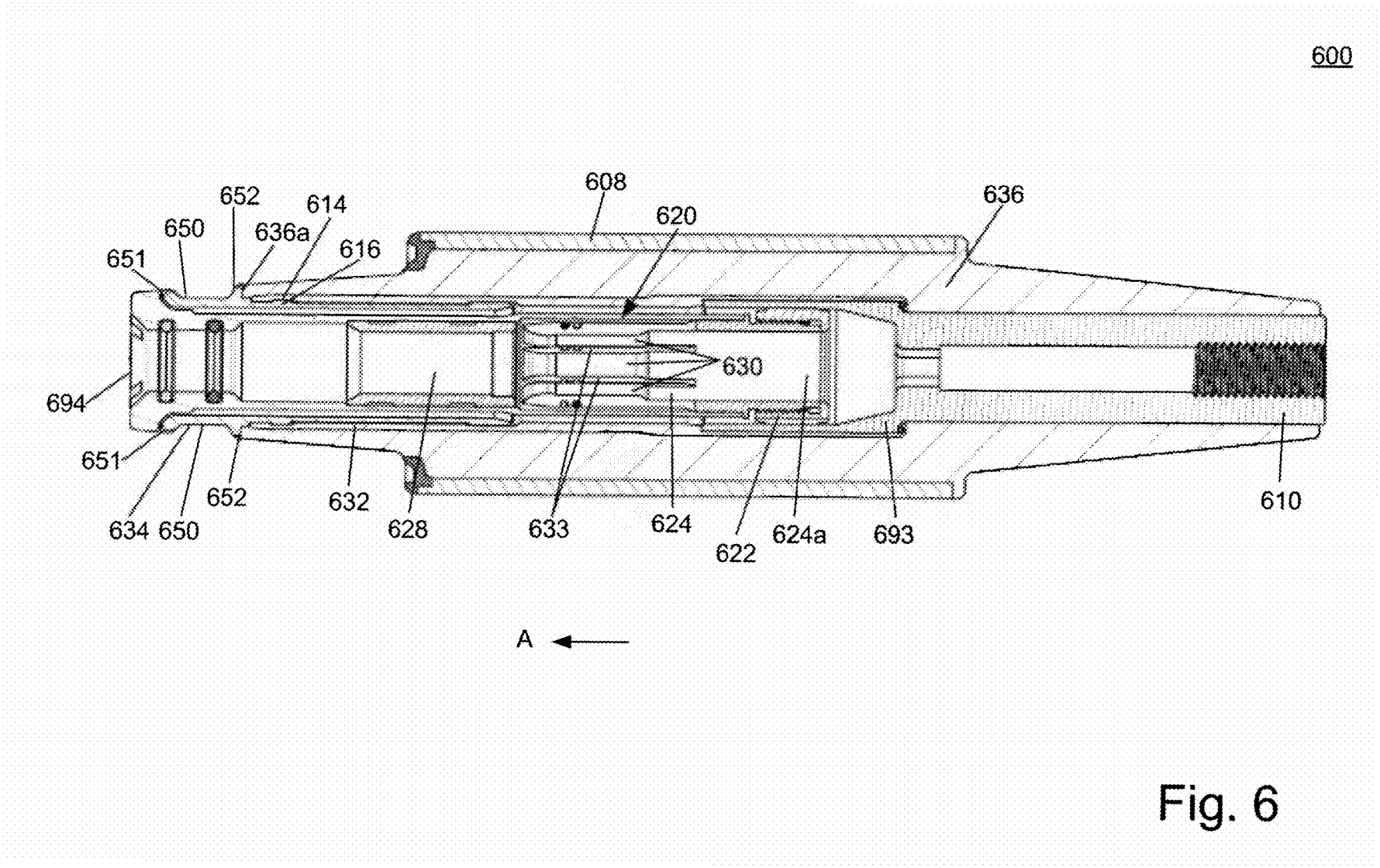
FIG. 6 is a longitudinal cross-sectional view of a separable male connector, according to certain additional alternative exemplary embodiments.
Figure 7:
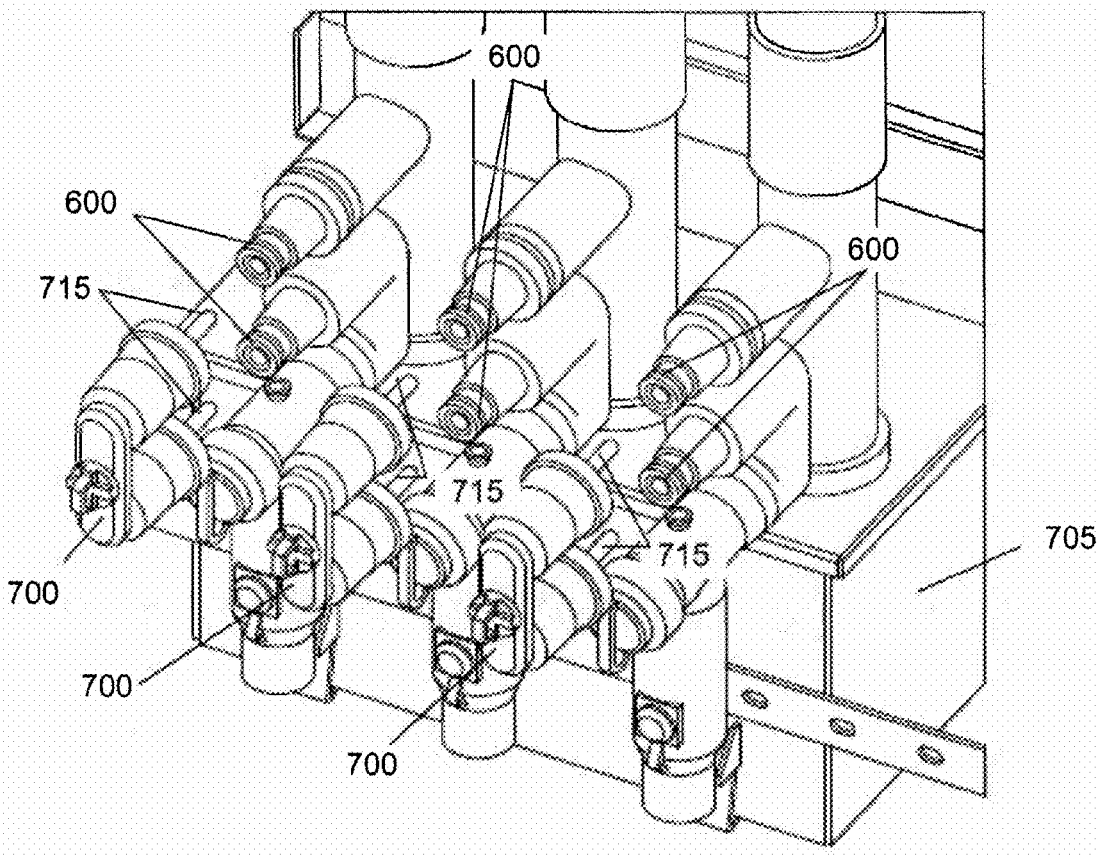
FIG. 7 is a partially exploded isometric view of ganged separable female connectors and separable male connectors of FIG. 6 connected to an electrical apparatus.

FIG. 6 is a longitudinal cross-sectional view of a separable male connector 600, according to certain additional alternative exemplary embodiments. FIG. 7 is a partially exploded isometric view of ganged, separable female connectors 700 and separable male connectors 600 of FIG. 6 connected to an electrical apparatus 705. For example, the electrical apparatus 705 can include a capacitor, transformer, switchgear, or other live front or dead front electrical apparatus.

The female connectors 700 and male connectors 600 are configured to be selectively engaged and disengaged to make or break an energized connection in a power distribution network including the electrical apparatus 705. In certain exemplary embodiments, each male connector 600 can be similar to the male connector 104 shown in FIG. 1 and/or the male connector 231 shown in FIG. 2, and each female connector 700 can be similar to the female connector 102 illustrated in FIG. 1 and/or the female connector 221 illustrated in FIGS. 2-4. The connectors 600, 700 may or may not include clearance regions for accommodating a push-then-pull operation.

Each male connector 600 includes a semi-conductive shield 608 disposed at least partially about an elongated insulated body 636. The insulated body 636 includes elastomeric insulating material, such as molded peroxide-cured EPDM. A conductive shield housing 632 extends within the insulated body 636, substantially about a contact assembly 620. A non-conductive nose piece 634 is secured to an end of the shield housing 632, proximate a "nose end" 694 of the male connector 600. The elastomeric insulating material of the insulated body 636 surrounds and bonds to an outer surface of the shield housing 632 and to a portion of the nose piece 634.

The contact assembly 620 includes a conductive piston 622, female contact 624, and arc interrupter 628. The piston 622 includes an axial bore and is internally threaded to engage external threads of a bottom portion 624*a* of the finger contact 624 and thereby fixedly mount or secure the finger contact 624 to the piston 622 in a stationary manner. In certain exemplary embodiments, the piston 622 can be knurled around its outer circumferential surface to provide a frictional, biting engagement with a piston holder 693 to ensure electrical contact therebetween. The piston 622 provides resistance to movement of the finger contact 624 until a sufficient pressure is achieved in a fault closure condition. The piston 622 is positionable or slidable within the shield housing 632 to axially displace the contact assembly 620 in the direction of arrow A during the fault closure condition. For example, arc quenching gas released from the arc interrupter 628 during a fault closure condition can cause the piston 622 to move in the direction of arrow A.

The finger contact 624 includes a generally cylindrical contact element with a plurality of axially projecting contact fingers 630 extending therefrom. The contact fingers 630 may be formed by providing a plurality of slots 633 azimuthally spaced around an end of the female contact 624. The contact fingers 630 are deflectable outwardly when engaged to a probe 715 of a mating, female connector 700 to resiliently engage outer surfaces of the probe 715.

The arc interrupter 628 includes a generally cylindrical member fabricated from a nonconductive or insulative material, such as plastic. In a fault closure condition, the arc interrupter 628 generates de-ionizing, arc quenching gas, the pressure buildup of which overcomes the resistance to movement of the piston 622 and causes the contact assembly 620 to accelerate, in the direction of arrow A, toward the nose end 694 of the male connector 600, to more quickly engage the finger contact element 624 with the probe 710. Thus, movement of the contact assembly 620 in fault closure conditions is assisted by arc quenching gas pressure.

In certain exemplary embodiments, the nose piece 634 is fabricated from a nonconductive material and is generally tubular or cylindrical. The nose piece 634 is fitted onto the nose end 694 of the male connector 600, and extends in contact with an inner surface of the shield housing 632. An external rib or flange 616 is fitted within an annular groove 614 of the shield housing 632, thereby securely retaining the nose piece 634 to the shield housing 632.

A portion of the nose piece 634 extending from an end 636*a* of the insulated body 636 includes an undercut segment 650 disposed between an outer interface segment 651 and an inner interface segment 652 of the nose piece 634. Each of the interface segments 651, 652 is configured to engage an interior surface of the corresponding female connector 700. For example, each interface segment 651, 652 can be configured to engage semi-conductive material extending along an interior portion of an inner surface of a housing of the female connector 700 (similar to the material 190 illustrated in FIG. 1). The undercut segment 650 is recessed between the interface segments 651, 652 so that the undercut segment 650 will not engage the interior surface of the female connector 700 when the male connector 600 and female connector 700 are engaged. In certain exemplary embodiments, the semi-conductive material engaged by the interface segments 651, 652 can include at least a portion of a faraday cage of the female connector 700. Thus, the undercut segment 650 can be disposed beneath the faraday cage.

The undercut segment 650 can have any depth greater than zero that causes an outside diameter of the undercut segment 650 to be less than an inside diameter of a corresponding segment of an interior surface of the female connector 700. For example, the undercut segment 650 can have a depth of at least about 0.05 inches. By way of example only, in certain exemplary embodiments, the undercut segment 650 can have a depth of about 0.27 inches. The length of the undercut segment 650 can vary, depending on the relative sizes of the connectors 600, 700. For example, the undercut segment 650 can have a length of about 0.625 inches.

In conventional nose pieces, most or the entire outer surface of the portion of the nose piece extending from the end 636*a* of the insulated body 636 interfaces with the interior surface of the corresponding female connector 700. The traditional motivation for this design was to prevent partial discharge ("PD") and encourage voltage containment by having the nose piece and other components of the male connector engage the female connector 700 in a form-fit manner. However, as described above, this form-fit relationship made it difficult for an operator to separate the connectors during an electrical disconnection operation.

The exemplary male connector 600 depicted in FIGS. 6 and 7 addresses this concern by including two interface segments 651, 652 for preventing PD and encouraging voltage containment, while limiting the surface area of the nose piece 634 that interfaces with the interior surface of the female connector 700. In certain exemplary embodiments, the total surface area may be reduced by about 20% to about 40% or more, thereby reducing a surface tension between the male and female connectors 600, 700 that must be overcome when separating the connectors 600, 700.

This reduction in surface area allows air to rest between the undercut segment 650 and the interior surface of the female connector 700, reducing a pressure drop within the female connector 700 when separating the connectors 600, 700. For example, the reduction in pressure drop can make separation of the connectors 600, 700 easier to perform because less suction works against the operator. The reduction in pressure also can improve switching performance because there is less likelihood of partial vacuum induced flashover. As described below with reference to FIG. 8, in certain alternative exemplary embodiments, the total surface area of the nose piece may be reduced up to 100%. For example, the nose piece 634 may include only one or no interface segments in certain alternative exemplary embodiments.

In certain exemplary embodiments, the undercut segment 650 also may function as a locking groove, substantially as described above with reference to FIG. 1. For example, the undercut segment 650 may include a latching clearance region sized and configured to accommodate relative movement of the locking groove and a locking ring of the female connector 700 during a push-then-pull operation.

In certain alternative exemplary embodiments, the connector 600 may include both an undercut segment 650 and another locking groove (not shown) configured to receive a locking ring (not shown) of the female connector 700. For example, the insulated body 636 proximate the undercut segment 650 may include the locking groove. The locking groove may or may not include a latching clearance region for accommodating a push-then-pull operation.

Figure 8:
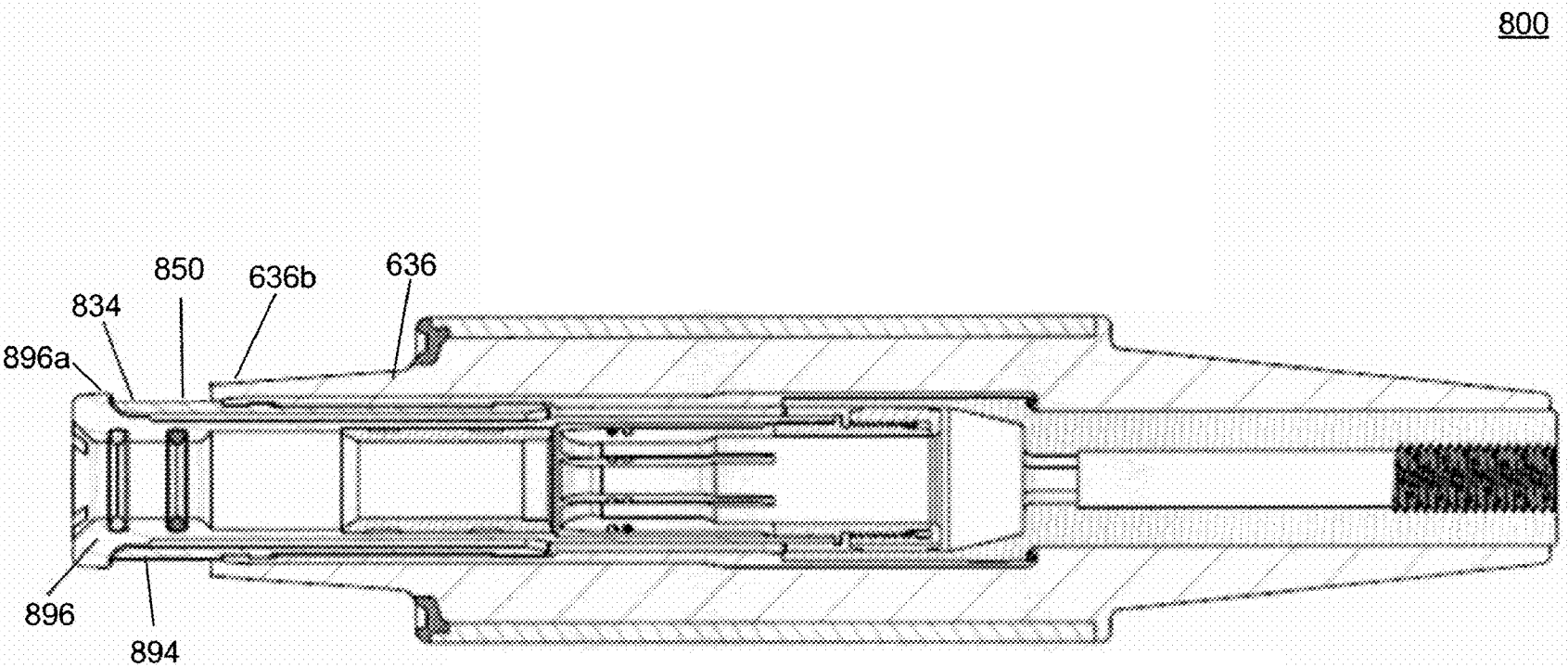
FIG. 8 is a longitudinal cross-sectional view of a separable male connector, according to certain additional alternative exemplary embodiments.

FIG. 8 is a longitudinal cross-sectional view of a separable male connector 800, according to certain additional alternative exemplary embodiments. The male connector 800 is substantially similar to the male connector 600 of FIGS. 6-7, except that the connector 800 includes a different shaped nose piece 834 than the nose piece of the connector 600 of FIGS. 6-7.

Specifically, the connector 800 includes a nose piece 834 including an undercut segment 850 without interfacing segments. Thus, no portion of the nose piece 834 will engage an interior surface of a corresponding female connector (not shown in FIG. 8) when the connectors are connected. Other portions of a nose end 894 of the connector 800 may interface with the interior surface of the female connector to prevent PD and to encourage voltage containment. For example, an outer surface 636*b* of a portion of the insulated body 636 of the connector 800 may engage the interior surface of the Faraday cage when the connectors are connected. Thus, the connector 800 addresses PD prevention and voltage containment while limiting the surface area of the nose piece 834 that interfaces with the interior surface of the female connector. Similarly, an outer surface 896*a* of a contact tube 896 of the connector 800 may or may not engage the interior surface when the connectors are connected. As set forth above, this reduction in surface area allows air to rest between the undercut segment 850 and the interior surface of the female connector, making it easier to separate the connectors when the connectors are disconnected.

Figure 9:
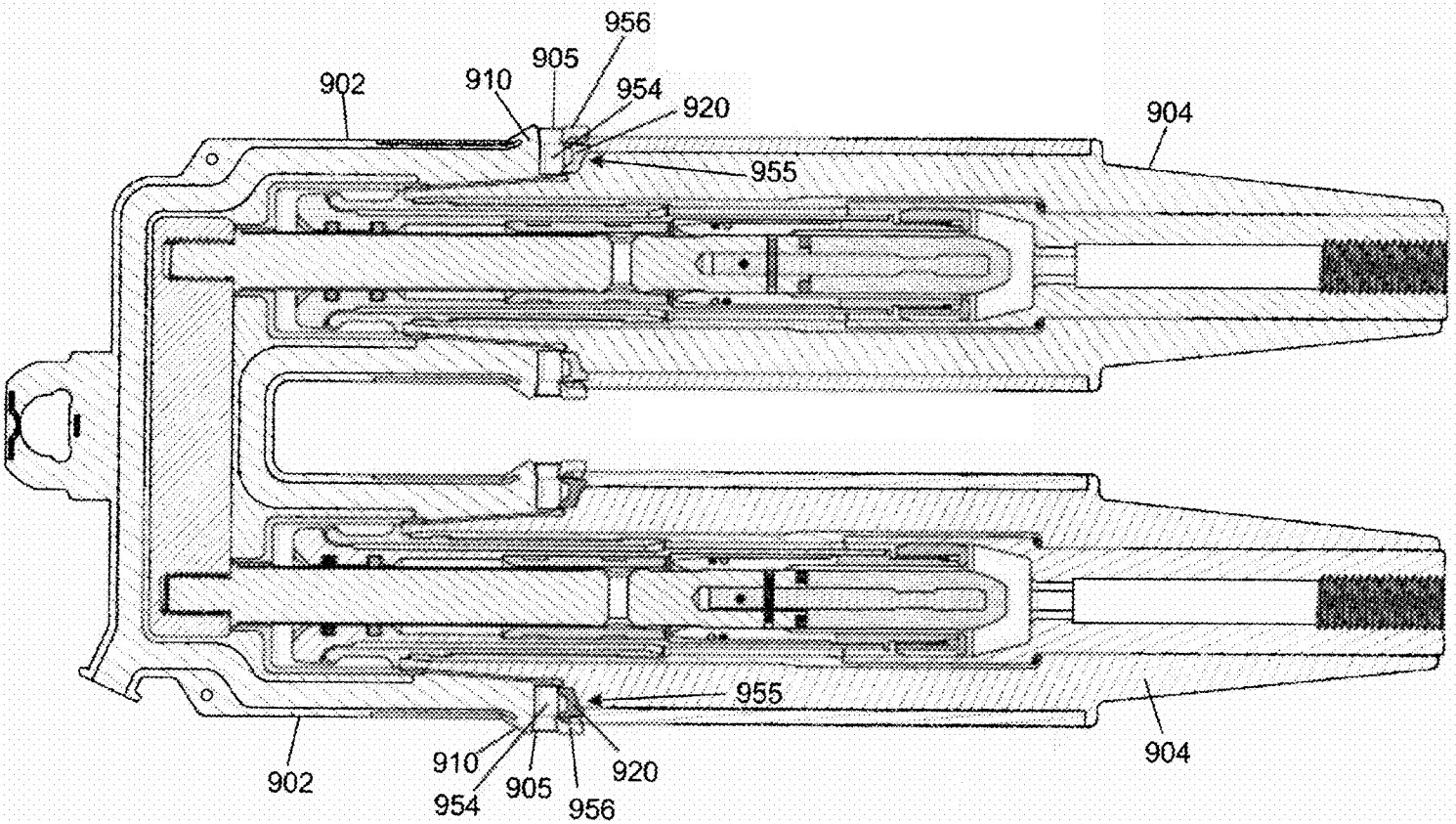
FIG. 9 is a longitudinal cross-sectional view of a separable connector system in an electrically connected operating position, according to certain additional alternative exemplary embodiments.
Figure 10:
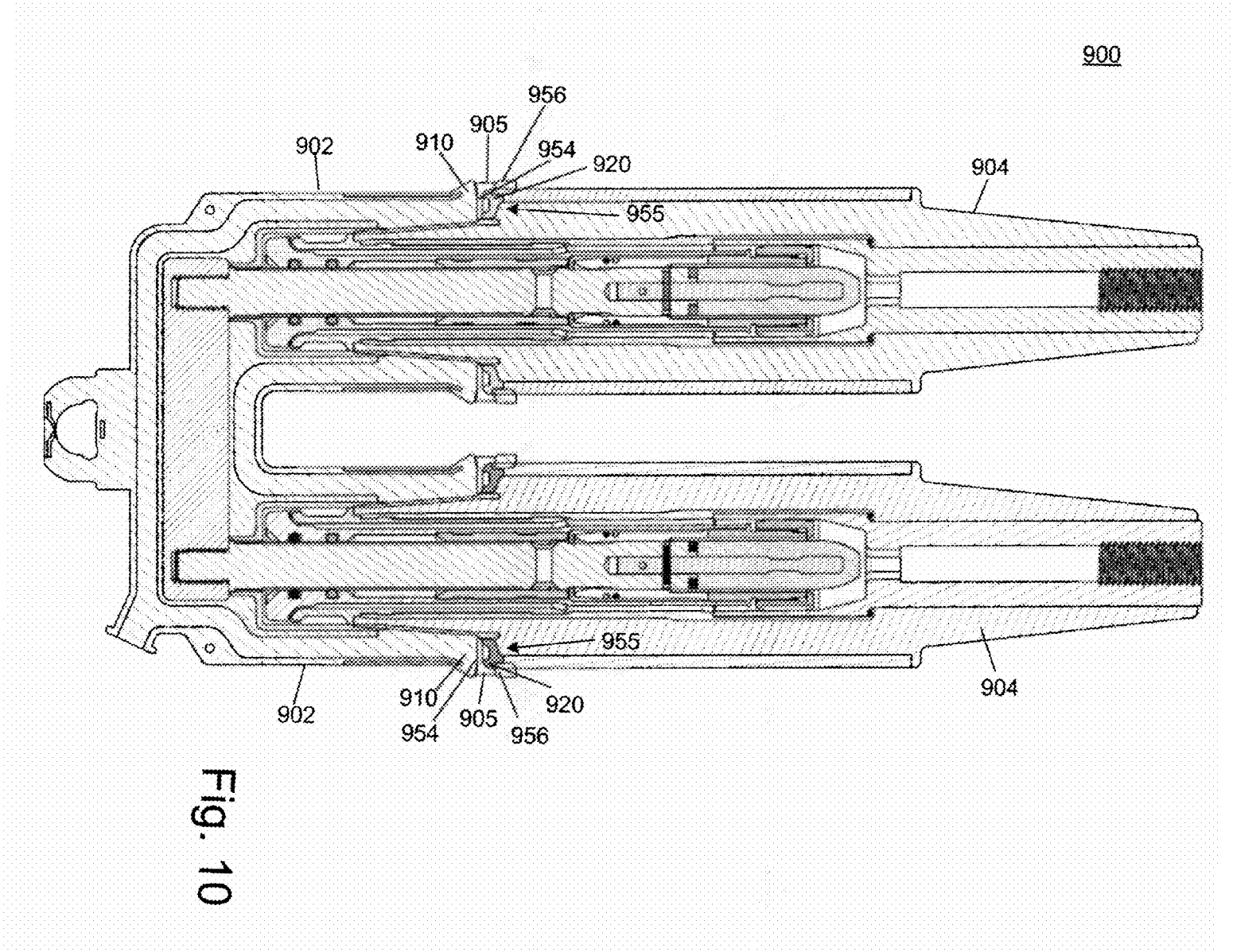
FIG. 10 is a longitudinal cross-sectional view of the separable connector system of FIG. 9 in a pushed-in position, according to certain additional alternative exemplary embodiments.

FIG. 9 is a longitudinal cross-sectional view of a separable connector system 900 in an electrically connected operating position, according to certain additional alternative exemplary embodiments. FIG. 10 is a longitudinal cross-sectional view of the separable connector system 900 of FIG. 9 in a pushed-in position. The system 900 includes ganged female connectors 902 and corresponding male connectors 904. The connectors 902 and 904 are similar to the connectors 102 and 104, respectively, of the system 100 of FIG. 1, except that the connectors 902 and 904 of the system 900 include a position indicator functionality, for visually indicating to an operator whether the connector system 900 is in the operating position or in the pushed-in position. As would be readily apparent to a person of ordinary skill in the art having the benefit of the present disclosure, the system 900 can include a single, non-ganged female connector 902 and a single corresponding male connector 904 in certain alternative exemplary embodiments.

In certain exemplary embodiments, the position indicator functionality is achieved via one or more windows 905 in an end 956 of a housing 910 of each female connector 902. Each window 905 is disposed within or along at least a portion of a shoulder clearance region 954 in the housing 910. The shoulder clearance region 954 is substantially identical to the shoulder clearance region 154 described above in connection with the system 100. Each window 905 includes an opening, channel, and/or translucent or semi-translucent material, such as clear plastic or clear rubber, through which an indicator 920 may be seen.

In an exemplary embodiment, each window 905 can include one or more openings or channels that extend angularly or perpendicularly through at least a portion of the end 956 of the housing 910 to expose the shoulder clearance region 954. Alternatively or additionally, one or more of the windows 905 can include a translucent or semi-translucent material that allows viewing of the shoulder clearance region 954 from an exterior of the housing 910.

The indicator 920 is integral to or coupled to a shoulder 955 of the male connector 904. In certain exemplary embodiments, the indicator 920 includes a material on which a pattern of one or more lines, shapes, letters, words, and/or colors is embossed, painted, etched, or otherwise presented. For example, the indicator 920 can include a portion of the shoulder 955 on which the letter "P" has been painted. Alternatively, the indicator 920 can include a yellow-colored ring disposed at least partially around a portion of the shoulder 955.

As illustrated in FIG. 10, when the separable connector system 900 is in the pushed-in-position, the indicator 920 is aligned with the window(s) 905. When the indicator 920 and window(s) 905 are aligned, at least a portion of the indicator 920 is visible through the window(s) 905. As illustrated in FIG. 9, when the separable connector system 900 is in a regular, operating position, the indicator 920 and window(s) 905 are not aligned. When the indicator 920 and window(s) 905 are not aligned, the indicator 920 is not visible through the window(s) 905.

Thus, the indicator 920 is visible when the connector system 900 is in the pushed-in-position, and the indicator 920 is not visible when the connector system 900 is in the operating position. Alternatively, the indicator 920 is aligned with the window(s) 905 when the connector system 900 is in the pushed-in-position, and the indicator 920 is not aligned with the window(s) 905 when the connector system 900 is in the operating position. In this alternative arrangement, a portion of the indicator 920 may be visible at an angle through the window(s) 905 when the connector system 900 is in the operating position.

The visual indication by the indicator 920 of the position of the connector system 900 allows an operator to easily determine what state the connector system 900 is in during a push-then-pull operation. For example, if the indicator 920 is visible through the window(s) 905, then the operator can determine that the connector system 900 is in a fully-pushed-in state. Similarly, if the indicator 920 is not visible through the window(s) 905, then the operator can determine that the connector system 900 is not in a fully-pushed-in state.

For a push-then-pull operation, the connector system should be operated normally in the position illustrated in FIG. 9. Accordingly, when the connectors 902, 904 are pushed together for normal operation, the operator should position the connectors 902, 904 as illustrated in FIG. 9. Then, to separate the connectors 902, 904, the operator can push the connector 904 into the connector 902 and then pull the connector 904 from the connector 902.

When the connectors 902, 904 are pushed together for normal operation, the operator should avoid positioning the connectors 902, 904 as illustrated in FIG. 10. If the connectors 902, 904 are position as illustrated in FIG. 10, then the operator will not be able to perform the push-then-pull operation to separate the connectors. Accordingly, if the operator can see the indicator 920 in the window(s) 905 when connecting the connectors 902, 904, then the operator can withdraw the connector 904 from the connector 902 until the connectors 902, 904 are positioned as illustrated in FIG. 9.

In certain exemplary embodiments, the indicator 920 is visible when the connectors 902, 904 are not completely pushed together for normal operation. For example, the indicator 920 can be sized such that, when the connectors 902, 904 are in a normal operating position, the indicator 920 is shielded from an operator's view by the end 956 of the connector 902. When the connectors 902, 904 are not completely pushed together in the normal operating position, the indicator 920 is not completely shielded by the end 956. Therefore, at least a portion of the indicator 920 is visible by the operator when the connectors 902, 904 are not completely pushed together in the normal operating position.

In addition to supporting the position indication functionality described above, one or more of the window(s) 905 also can be configured to reduce the risk of flashover and/or the required operating force when separating the connectors 902 and 904. In particular, each window 905 can remove or reduce a vacuum or partial vacuum between its corresponding connectors 902 and 904, proximate the end 956 of the connector 902, by providing an air path along the end 956 and the shoulder 955. For example, if the window 905 includes a channel that extends through the end 956, the window 905 can provide an air path that allows ingress of air through the channel and between the connectors 902 and 904, proximate the end 956, thereby removing or reducing any vacuum or partial vacuum in the shoulder clearance region 954 when separating the connectors 902, 904.

Figure 11:
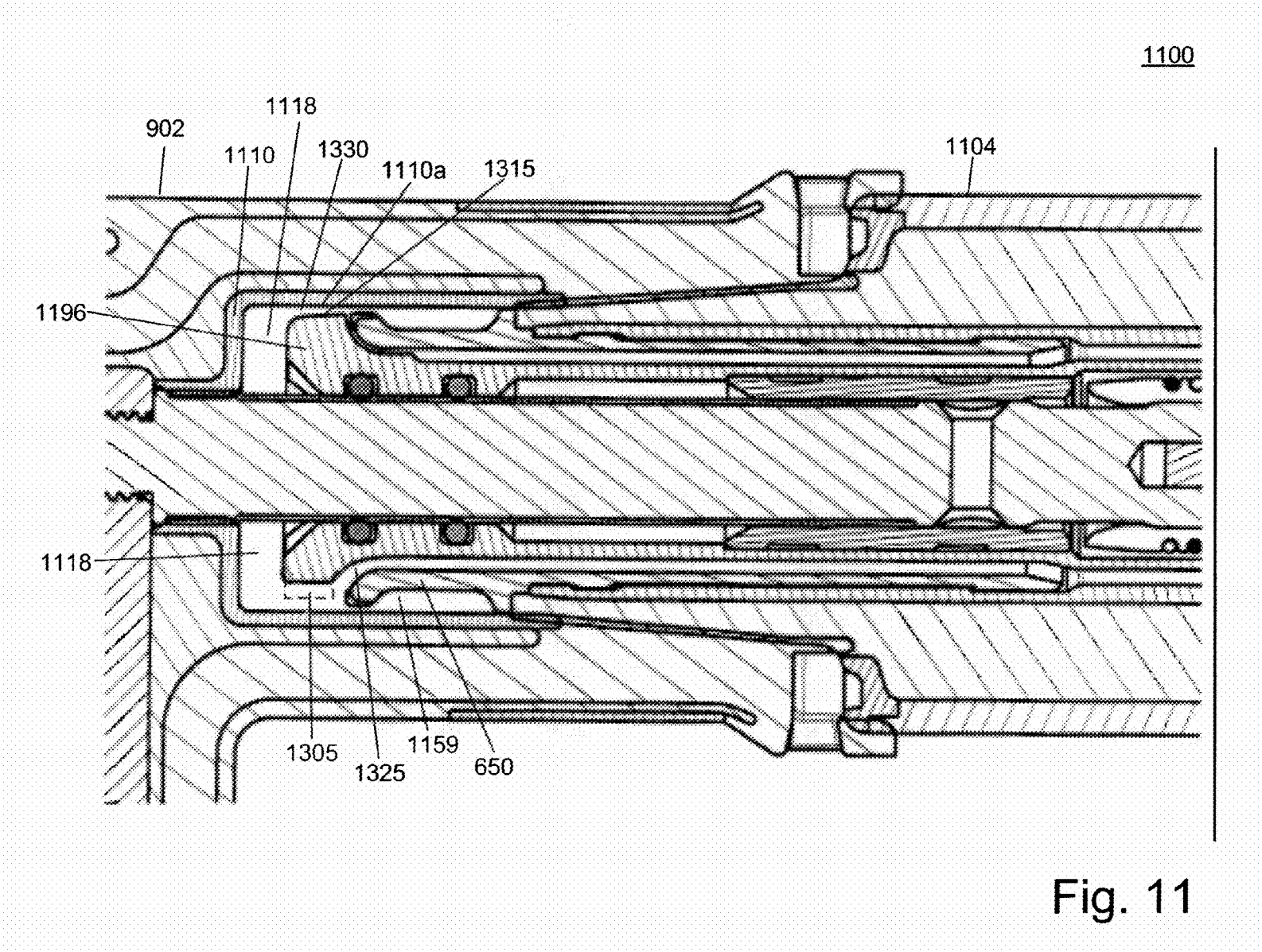
FIG. 11 is a longitudinal cross-sectional view of a portion of a separable connector system in an electrically connected operating position, according to certain additional alternative exemplary embodiments.
Figure 12:
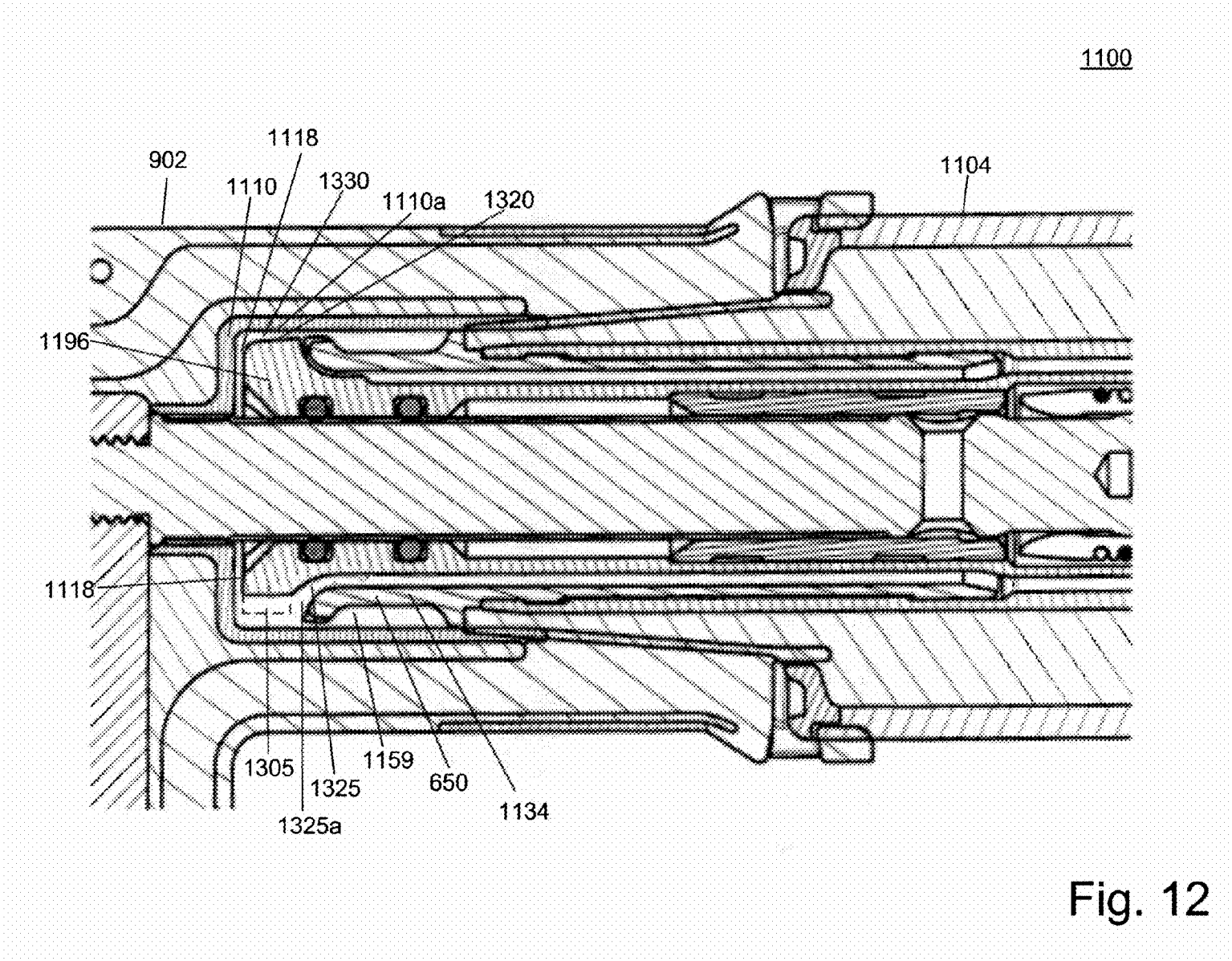
FIG. 12 is a longitudinal cross-sectional view of the portion of the separable connector system of FIG. 11 in a pushed-in position, according to certain additional alternative exemplary embodiments.

FIG. 11 is a longitudinal cross-sectional view of a portion of a separable connector system 1100 in an electrically connected operating position, according to certain additional alternative exemplary embodiments. FIG. 12 is a longitudinal cross-sectional view of the portion of the separable connector system 1100 of FIG. 11 in a pushed-in position. The separable connector system 1100 is substantially identical to the separable connector system 900, except that a contact tube 1196 of each male connector 1104 of the system 1100 is sized and configured to remove or reduce a vacuum or partial vacuum between the contact tube 1196 and the housing 1110 of its corresponding female connector 902, proximate a cup-shaped recess 1118 of the female connector 902.

Figure 13:
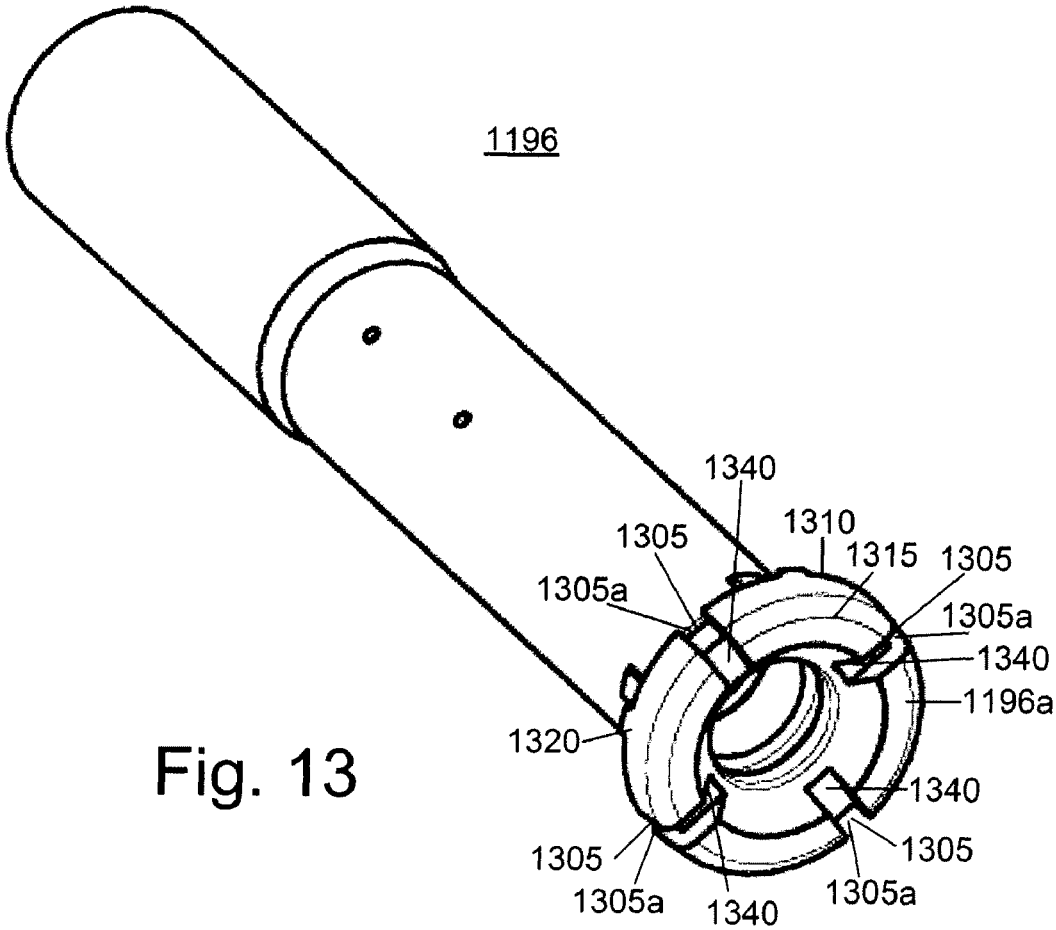
FIG. 13 is a perspective side view of a contact tube of the separable connector system of FIG. 11, in accordance with certain exemplary embodiments.
Figure 14:
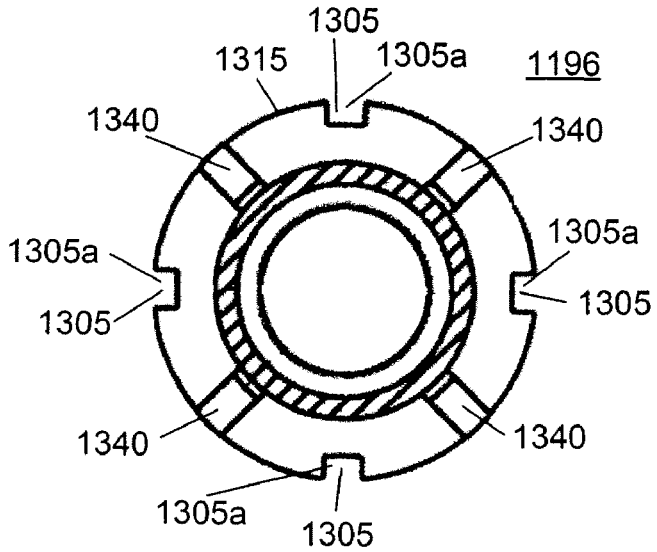
FIG. 14 is an elevational side view of the contact tube of FIG. 13, in accordance with certain exemplary embodiments.

FIG. 13 is a perspective side view of the contact tube 1196 illustrated in FIGS. 10 and 11, in accordance with certain exemplary embodiments. FIG. 14 is an elevational side view of the contact tube 1196, in accordance with certain exemplary embodiments. With reference to FIGS. 11-14, the contact tube 1196 is similar to the contact tube 196 of the system 100 of FIG. 1, except that the contact tube 1196 includes vents 1305 in a nose end **1196*a* of the contact tube 1196. Each vent 1305 includes a channel 1305*a* that extends between an inner edge 1310 and an end edge 1315 of the contact tube 1196, along an outer side surface 1320 of the nose end 1196*a* of the contact tube 1196. In certain exemplary embodiments, the vents 1305 are circumferentially spaced along the side surface 1320, substantially along a linear axis of the contact tube 1196**.

Although depicted in FIGS. 13-14 as having four vents 1196, the contact tube 1196 can have only one or any suitable number of vents 1305 in certain alternative exemplary embodiments. The size of the vents 1196 can vary depending on the size of the contact tube 1196 and the desired amount of air flow between the connectors 902 and 1104. For example, and without limiting the invention in any way, each vent 1305 can have a depth of about 0.15 inches and a width of about 0.15 inches in certain exemplary embodiments.

The vents 1305 provide an air path between the housing 1110 of the female connector 902 and a gap 1325 between the contact tube 1196 and a nose piece 1134 of the male connector 1104, proximate a latching clearance region 1159 or undercut segment 650 in the nose piece 1134. This air path allows ingress of air from the gap 1325 to the cup-shaped recess 1118 of the female connector 902 when the connectors 902 and 1104 are separated, whether by a push-then-pull operation or otherwise. By allowing such ingress of air, the air path provides for the removal or reduction of any vacuum or partial vacuum that otherwise might be present or might be created in the cup-shaped recess 1118 during the separation of the connectors 902 and 1104. As set forth above, removing or reducing such a vacuum or partial vacuum can prevent flashover and also can reduce the required operating force for separating the connectors 902 and 1104. The air path also allows egress of air from the cup-shaped recess 1118 to the gap 1325 when the connectors 902 and 1104 are connected together, thereby reducing the operating force required to connect the connectors 902 and 1104.

In addition to supporting the above venting functions, the gap 1325 provides a venting path for particles and gases generated internally to the connector 1104 during a loadbreak operation. The venting path vents the particles and gases through a terminal portion 1325*a* that is divergent from a linear axis of the connector 1104. The vents 1305 provide an air path from that terminal portion 1325*a* to the cup-shaped recess 1118. In certain alternative exemplary embodiments, the gap 1325 includes a terminal portion that is parallel to the linear axis of the connector 1104. As with the terminal portion 1325*a*, the vents 1305 can provide an air path from that terminal portion to the cup-shaped recess 1118.

The vents 1305 may or may not be aligned with certain alignment notches 1340 on an end surface 1345 of the nose end 1196*a*. For example, FIG. 13 illustrates the vents 1305 aligned with the alignment notches 1340, while FIG. 14 illustrates the vents 1305 spaced apart from the alignment notches 1340. The alignment notches 1340 extend substantially perpendicularly to the vents 1305 and are generally used in assembly of the connectors 902 and 1104, to ensure proper alignment of the contact tube 1196 within the connector 1104.

In certain exemplary embodiments, in addition to the vents 1305, or in place of the vents 1305, a gap 1330 can be provided between the outer side surface 1320 of the contact tube 1196 and an internal side edge 1110*a* of the housing 1110, proximate the recess 1118. Similarly to the vents 1305, the gap 1330 provides an air path between the housing 1110 of the female connector 902 and the contact tube 1196, proximate the recess 1118. The gap 1330 may be present around all or a portion of the nose end 1196*a* of the contact tube 1196. In certain exemplary embodiments, the gap 1330 may exist because of a reduced diameter of the nose end 1196*a* of the contact tube 1196 as compared to other contact tubes without the gap 1330, and/or because of an increased diameter of the recess 1118 in the housing 910 as compared to recesses in other housings 910 without the gap 1330. The size of the gap 1330 can vary depending on the size of the contact tube 1196, the size of the housing 910, and/or the desired amount of air flow between the connectors 902 and 1104. For example, and without limiting the invention in any way, the gap 1330 can have a width of about 0.05 inches in certain exemplary embodiments.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art without departing from the spirit and scope of the present invention defined in the following claims, the scope of which is to be accorded the broadest interpretation so as to encompass such modifications and equivalent structures.

What is claimed is:

1. A separable loadbreak connector system, comprising:

a first connector;

a second connector selectively positionable relative to the first connector to open and close a circuit, the first and second connectors comprising a plurality of separate clearance regions sized and configured to accommodate a push-then-pull operation of the first and second connectors from an operating position to a pushed-in-position and from the pushed-in position to a released position to open the circuit, wherein each clearance region defines a space within which a respective portion of the second connector slides when the connectors are pushed further together in a mating direction during the push-then-pull operation; and an indicator configured to indicate whether the first and second connectors are in the pushed-in-position or the operating position.

2. The separable connector system of claim 1, wherein the indicator is integral to one of the first and second connectors.

3. The separable connector system of claim 1, wherein the indicator is coupled to one of the first and second connectors.

4. The separable connector system of claim 1, wherein the indicator comprises a ring disposed around at least a portion of one of the first and second connectors.

5. The separable connector system of claim 1, wherein the indicator comprises a material that is visible to an operator of the first and second connectors when the first and second connectors are in the pushed-in position.

6. The separable connector system of claim 1, wherein one of the first and second connectors comprises a window through which the indicator is visible when the first and second connectors are in the pushed-in position.

7. The separable connector system of claim 6, wherein the window comprises a channel extending at least partially through the one of the first and second connectors.

8. The separable connector system of claim 6, wherein one of the first and second connectors comprises a shoulder and the other of the first and second connectors comprises a housing, and wherein one of the first and second connectors further comprises a shoulder clearance region sized and configured to accommodate relative movement of the shoulder and the housing during the push-then-pull operation, the window being disposed within or along at least a portion of the shoulder clearance region.

9. A separable loadbreak connector system, comprising:

a first connector;

a second connector selectively positionable relative to the first connector to open and close a circuit, the first and second connectors comprising a plurality of separate clearance regions sized and configured to accommodate a push-then-pull operation of the first and second connectors from an operating position to a pushed-in-position and from the pushed-in position to a released position to open the circuit, wherein each clearance region defines a space within which a respective portion of the second connector slides when the connectors are pushed further together in a mating direction during the push-then-pull operation; and an indicator configured to indicate whether the first and second connectors are in the pushed-in-position or the operating position, the indicator comprising a material that is visible to an operator of the first and second connectors when the first and second connectors are in the pushed-in position.

10. The separable connector system of claim 9, wherein the indicator is integral to one of the first and second connectors.

11. The separable connector system of claim 9, wherein the indicator is coupled to one of the first and second connectors.

12. The separable connector system of claim 9, wherein the indicator comprises a ring disposed around at least a portion of one of the first and second connectors.

13. The separable connector system of claim 9, wherein one of the first and second connectors comprises a window through which the indicator is visible when the first and second connectors are in the pushed-in position.

14. The separable connector system of claim 13, wherein the window comprises a channel extending at least partially through the one of the first and second connectors.

15. The separable connector system of claim 13, wherein one of the first and second connectors comprises a shoulder and the other of the first and second connectors comprises a housing, and wherein one of the first and second connectors further comprises a shoulder clearance region sized and configured to accommodate relative movement of the shoulder and the housing during the push-then-pull operation, the window being disposed within or along at least a portion of the shoulder clearance region.

16. A separable loadbreak connector system, comprising:

a first connector comprising a window;

a second connector selectively positionable relative to the first connector to open and close a circuit, the first and second connectors comprising a plurality of separate clearance regions sized and configured to accommodate a push-then-pull operation of the first and second connectors from an operating position to a pushed-in-position and from the pushed-in position to a released position to open the circuit, wherein each clearance region defines a space within which a respective portion of the second connector slides when the connectors are pushed further together in a mating direction during the push-then-pull operation; and an indicator configured to indicate whether the first and second connectors are in the pushed-in-position, wherein the indicator is aligned with the window of the first connector when the first and second connectors are in the pushed-in position.

17. The separable connector system of claim 16, wherein the indicator is integral to the second connector.

18. The separable connector system of claim 16, wherein the indicator is coupled to the second connector.

19. The separable connector system of claim 16, wherein the indicator comprises a ring disposed around at least a portion of the second connector.

20. The separable connector system of claim 16, wherein the window comprises a channel extending at least partially through the first connector.

21. The separable connector system of claim 16, wherein the first connector comprises a housing and the second connector comprises a shoulder, and wherein a shoulder clearance region exists between the housing and the shoulder, the shoulder clearance region being sized and configured to accommodate relative movement of the shoulder and the housing during the push-then-pull operation, the window being disposed within or along at least a portion of the shoulder clearance region.

* * * * *